US011462236B2

(12) United States Patent
Bryan

(10) Patent No.: US 11,462,236 B2
(45) Date of Patent: Oct. 4, 2022

(54) VOICE RECORDINGS USING ACOUSTIC QUALITY MEASUREMENT MODELS AND ACTIONABLE ACOUSTIC IMPROVEMENT SUGGESTIONS

(71) Applicant: Adobe Inc., San Jose, CA (US)

(72) Inventor: Nick Bryan, Belmont, CA (US)

(73) Assignee: Adobe Inc., San Jose, CA (US)

( * ) Notice: Subject to any disclaimer, the term of this patent is extended or adjusted under 35 U.S.C. 154(b) by 109 days.

(21) Appl. No.: 16/663,934

(22) Filed: Oct. 25, 2019

(65) Prior Publication Data

US 2021/0125629 A1 Apr. 29, 2021

(51) Int. Cl.

| | |
|---|---|
| ***G10L 25/60*** | (2013.01) |
| ***G10L 21/0216*** | (2013.01) |
| ***G10L 21/028*** | (2013.01) |
| ***G10L 21/0208*** | (2013.01) |

(52) U.S. Cl.

CPC ..... *G10L 25/60* (2013.01); *G10L 21/028* (2013.01); *G10L 21/0216* (2013.01); *G10L 2021/02082* (2013.01); *G10L 2021/02163* (2013.01)

(58) Field of Classification Search

None

See application file for complete search history.

(56) References Cited

U.S. PATENT DOCUMENTS

| | | | | |
|---|---|---|---|---|
| 2008/0162120 | A1* | 7/2008 | Mactavish | G10L 21/06 704/201 |
| 2014/0362984 | A1* | 12/2014 | Danson | H04M 3/5175 379/265.06 |
| 2016/0049094 | A1* | 2/2016 | Gupta | G09B 9/00 434/185 |
| 2017/0084295 | A1* | 3/2017 | Tsiartas | G10L 17/08 |
| 2018/0018984 | A1* | 1/2018 | Dickins | G10L 21/0232 |
| 2019/0281149 | A1* | 9/2019 | Every | H04R 29/001 |
| 2020/0105291 | A1* | 4/2020 | Sheaffer | H04R 3/10 |

OTHER PUBLICATIONS

Mirco Ravanelli; Deep Learning for Distant Speech Recognition; Dec. 17, 2016; URL: https://arxiv.org/pdf/1712.06086.pdf (Year: 2017).*

Pavel Zahorik; Direct-to-reverberant energy ratio sensitivity; Jun. 5, 2001 URL: https://asa.scitation.org/doi/pdf/10.1121/1.1506692 (Year: 2001).*

(Continued)

*Primary Examiner* — Richa Mishra

(74) *Attorney, Agent, or Firm* — Keller Preece PLLC

(57) ABSTRACT

The disclosure describes one or more embodiments of an acoustic improvement system that accurately and efficiently determines and provides actionable acoustic improvement suggestions to users for digital audio recordings via an interactive graphical user interface. For example, the acoustic improvement system can assist users in creating high-quality digital audio recordings by providing a combination of acoustic quality metrics and actionable acoustic improvement suggestions within the interactive graphical user interface customized to each digital audio recording. In this manner, all users can easily and intuitively utilize the acoustic improvement system to improve the quality of digital audio recordings.

20 Claims, 20 Drawing Sheets

(56) References Cited

OTHER PUBLICATIONS

1993. Objective Measurement of Active Speech Level, International Telecommunications Union (ITU-T) Recommendation p. 56. (1993).
Martín Abadi, Ashish Agarwal, Paul Barham, Eugene Brevdo, Zhifeng Chen, Craig Citro, Greg S. Corrado, Andy Davis, Jeffrey Dean, Matthieu Devin, Sanjay Ghemawat, Ian Goodfellow, Andrew Harp, Geoffrey Irving, Michael Isard, Yangqing Jia, Rafal Jozefowicz, Lukasz Kaiser, Manjunath Kudlur, Josh Levenberg, Dan Mané, Rajat Monga, Sherry Moore, Derek Murray, Chris Olah, Mike Schuster, Jonathon Shlens, Benoit Steiner, Ilya Sutskever, Kunal Talwar, Paul Tucker, Vincent Vanhoucke, Vijay Vasudevan, Fernanda Viégas, Oriol Vinyals, Pete Warden, Martin Wattenberg, Martin Wicke, Yuan Yu, and Xiaoqiang Zheng. 2015. TensorFlow: Large-Scale Machine Learning on Heterogeneous Systems. (2015). http://tensorflow.org/ Software available from tensorflow.org.
David Baird. 2019. Easywsclient: A Short and Sweet WebSocket Client for C++, code. (2019).
Lawrence Bergman, Vittorio Castelli, Tessa Lau, and Daniel Oblinger. 2005. DocWizards: A System for Authoring Follow-Me Documentation Wizards. In Proceedings of the 18th annual ACM symposium on User Interface Software and Technology. ACM, 191-200.
Brian McFee, Colin Raffel, Dawen Liang, Daniel P.W. Ellis, Matt McVicar, Eric Battenberg, and Oriol Nieto. 2015. Iibrosa: Audio and Music Signal Analysis in Python. In Proceedings of the 14th Python in Science Conference, Kathryn Huff and James Bergstra (Eds.). SciPy Organizers, 18-24.
John M Carroll, Penny L Smith-Kerker, James R Ford, and Sandra A Mazur-Rimetz. 1987. The Minimal Manual. Human-Computer Interaction 3, 2 (1987), 123-153.
Scott Carter, John Adcock, John Doherty, and Stacy Branham. 2010. NudgeCam: Toward targeted, higher quality media capture. In Proceedings of the 18th ACM International Conference on Multimedia. ACM, 615-618.
Ana Ramírez Chang and Marc Davis. 2005. Designing Systems That Direct Human Action. In CHI'05 Extended Abstracts on Human Factors in Computing Systems. ACM, ACM, 1260-1263.
Pei-Yu Chi, Sally Ahn, Amanda Ren, Mira Dontcheva, Wilmot Li, and Björn Hartmann. 2012. MixT: Automatic Generation of Step-by-Step Mixed Media Tutorials. In Proceedings of the 25th Annual ACM Symposium on User Interface Software and Technology. ACM, 93-102.
Françis Chollet and others. 2015. Keras. code. (2015).
Marc Davis. 2003. Active Capture: Integrating Human-Computer Interaction and Computer Vision/Audition to Automate Media Capture. In 2003 International Conference on Multimedia and Expo. ICME'03. Proceedings, vol. 2. IEEE, II-185.
Marc Davis, Jeffrey Heer, and Ana Ramírez. 2003. Active capture: automatic direction for automatic movies. In Proceedings of the 11th ACM International Conference on Multimedia. ACM, 88-89.
John Eargle. 2012. The Microphone Book: From Mono to Stereo to Surround—A Guide to Microphone Design and Application. CRC Press.
James Eaton, Nikolay D Gaubitch, Alastair H Moore, Patrick A Naylor, James Eaton, Nikolay D Gaubitch, Alastair H Moore, Patrick A Naylor, Nikolay D Gaubitch, James Eaton, and others. 2016. Estimation of Room Acoustic Parameters: The ACE challenge. IEEE/ACM Transactions on Audio, Speech and Language Processing (TASLP) 24, 10 (2016), 1681-1693.
Angelo Farina. 2000. Simultaneous Measurement of Impulse Response and Distortion with a Swept-Sine Technique. In Audio Engineering Society Convention 108. Audio Engineering Society.
Jennifer Fernquist, Tovi Grossman, and George Fitzmaurice. 2011. Sketch-Sketch Revolution: An Engaging Tutorial System for Guided Sketching and Application Learning. In Proceedings of the 24th Annual ACM Symposium on User Interface Software and Technology. ACM, 373-382.
Hannes Gamper and Ivan J Tashev. 2018. Blind Reverberation Time Estimation Using a Convolutional Neural Network. In 16th International Workshop on Acoustic Signal Enhancement (IWAENC). IEEE, 136-140.
Timo Gerkmann and Richard C Hendriks. 2012. Unbiased MMSE-based noise power estimation with low complexity and low tracking delay. IEEE Transactions on Audio, Speech, and Language Processing 20, 4 (2012), 1383-1393.
Saul Greenberg and Bill Buxton. 2008. Usability evaluation considered harmful (some of the time). In Proceedings of the SIGCHI Conference on Human Factors in Computing Systems. ACM, 111-120.
Susan M Harrison. 1995. A Comparison of Still, Animated, or Nonillustrated On-Line Help With Written or Spoken Instructions in a Graphical User Interface. In Proceedings of the SIGCHI Conference on Human Factors in Computing Systems. 82-89.
Jeffrey Heer, Nathaniel S Good, Ana Ramirez, Marc Davis, and Jennifer Mankoff. 2004. Presiding over accidents: system direction of human action. In Proceedings of the SIGCHI Conference on Human Factors in Computing Systems. ACM, 463-470.
T Houtgast and H. J. M. Steeneken. 1973. The Modulation Transfer Function in Room Acoustics as a Predictor of Speech Intelligibility. Acta Acustica United with Acustica 28, 1 (1973), 66-73.
David Miles Huber and Robert E Runstein. 2013. Modern Recording Techniques (8 ed.). Focal press.
ITU-R. 2012. Algorithms to Measure Audio Programme Loudness and True-Peak Audio Level. BS.1770, 3 (Aug. 2012).
Alan B Johnston and Daniel C Burnett. 2012. WebRTC: APIs and RTCWEB protocols of the HTML5 real-time web. Digital Codex LLC.
Matti Karjalainen and Hanna Jarvelainen. 2001. More About This Reverberation Science: Perceptually Good Late Reverberation. In Audio Engineering Society Convention 111. Audio Engineering Society.
Diederik P Kingma and Jimmy Ba. 2014. Adam: A Method for Stochastic Optimization. arXiv preprint arXiv:1412.6980 (2014).
Andy Kirk. 2016. Data Visualisation: A Handbook for Data Driven Design. Sage.
Balasaravanan T. Kumaravel, Cuong Nguyen, Stephen DiVerdi, and Björn Hartmann. 2019. TutoriVR: A Video-Based Tutorial System for Design Applications in Virtual Reality. In Proceedings of the SIGCHI Conference on Human Factors in Computing Systems. ACM.
Kazutaka Kurihara, Masataka Goto, Jun Ogata, Yosuke Matsusaka, and Takeo Igarashi. 2007. Presentation sensei: a presentation training system using speech and image processing. In Proceedings of the 9th International Conference on Multimodal Interfaces. ACM, 358-365.
FF Li and TJ Cox. 2003. Speech Transmission Index from Running Speech: A Neural Network Approach. The Journal of the Acoustical Society of America 113, 4 (2003), 1999-2008.
Heinrich Loellmann, Andreas Brendel, Peter Vary, and Walter Kellermann. 2015. Single-Channel Maximum-Likelihood T60 Estimation Exploiting Subband Information. arXiv preprint arXiv:1511.04063 (2015).
Niels Lohmann. 2019. JSON for Modern C++. code. (2019).
Brecht De Man. 2019. Loudness.py. code. (2019).
Justin Matejka, Tovi Grossman, and George Fitzmaurice. 2011. IP-QAT: In-Product Questions, Answers, & Tips. In Proceedings of the 24th Annual ACM Symposium on User Interface Software and Technology. ACM, 175-184.
David McShefferty, William M Whitmer, and Michael A Akeroyd. 2015. The Just-Noticeable Difference in Speech-to-Noise Ratio. Trends in hearing 19 (2015).
Sebastian Möller, Wai-Yip Chan, Nicolas Côté, Tiago H Falk, Alexander Raake, and Marcel Wältermann. 2011. Speech Quality Estimation: Models and Trends. IEEE Signal Processing Magazine 28, 6 (2011), 18-28.
Gautham J Mysore. 2015. Can We Automatically Transform Speech Recorded on Common Consumer Devices in Real-World Environments into Professional Production Quality Speech?—A Dataset, Insights, and Challenges. IEEE Signal Processing Letters 22, 8 (2015), 1006-1010.

(56) References Cited

OTHER PUBLICATIONS

Pablo Peso Parada, Dushyant Sharma, Toon van Waterschoot, and Patrick A Naylor. 2015. Evaluating the Non-Intrusive Room Acoustics Algorithm with the ACE Challenge. arXiv preprint arXiv:1510.04616 (2015).

Suporn Pongnumkul, Mira Dontcheva, Wilmot Li, Jue Wang, Lubomir Bourdev, Shai Avidan, and Michael F Cohen. 2011. Pause-and-Play: Automatically Linking Screencast Video Tutorials With Applications. In Proceedings of the 24th annual ACM Symposium on User Interface Software and Technology. ACM, 135-144.

Thiago de M Prego, Amaro A de Lima, Rafael Zambrano-López, and Sergio L Netto. 2015. Blind Estimators for Reverberation Time and Direct-to-Reverberant Energy Ratio Using Subband Speech Decomposition. In Workshop on Applications of Signal Processing to Audio and Acoustics (WASPAA). IEEE.

Javier Ramírez, José C Segura, Carmen Benitez, Angel De La Torre, and Antonio Rubio. 2004. Efficient Voice Activity Detection Algorithms Using Long-Term Speech Information. Speech communication 42, 3-4 (2004), 271-287.

Steve Rubin, Floraine Berthouzoz, Gautham J Mysore, and Maneesh Agrawala. 2015. Capture-time feedback for recording scripted narration. In Proceedings of the 28th Annual ACM Symposium on User Interface Software & Technology. ACM, 191-199.

Prem Seetharaman, Gautham Mysore, Bryan Pardo, Paris Smaragdis, and Celso Gomes. 2019. VoiceAssist: Guiding Users to High-Quality Voice Recordings. In Proceedings of the SIGCHI Conference on Human Factors in Computing Systems. ACM, 1-6.

Prem Seetharaman, Gautham J Mysore, Paris Smaragdis, and Bryan Pardo. 2018. Blind Estimation of the Speech Transmission Index for Speech Quality Prediction. In International Conference on Acoustics, Speech and Signal Processing (ICASSP). IEEE, 591-595.

Abhishek Sehgal and Nasser Kehtarnavaz. 2018. A convolutional neural network smartphone app for real-time voice activity detection. IEEE Access 6 (2018), 9017-9026.

Sayaka Shiota, Fernando Villavicencio, Junichi Yamagishi, Nobutaka Ono, Isao Echizen, and Tomoko Matsui. 2015. Voice Liveness Detection Algorithms Based on Pop Noise Caused by Human Breath for Automatic Speaker Verification. In Sixteenth Annual Conference of the International Speech Communication Association.

Jongseo Sohn, Nam Soo Kim, and Wonyong Sung. 1999. A statistical model-based voice activity detection. IEEE Signal Processing Letters 6, 1 (1999), 1-3.

J. Storer. 2019. JUCE: Jules' Utility Class Extensions, code. (2019).

Feifei Xiong, Stefan Goetze, and Bernd T Meyer. 2015. Joint Estimation of Reverberation Time and Direct-to-Reverberation Ratio from Speech Using Auditory-Inspired Features. arXiv preprint arXiv:1510.04620 (2015).

Pavel Zahorik. 2002. Direct-to-Reverberant Energy Ratio Sensitivity. The Journal of the Acoustical Society of America 112, 5 (2002), 2110-2117.

* cited by examiner

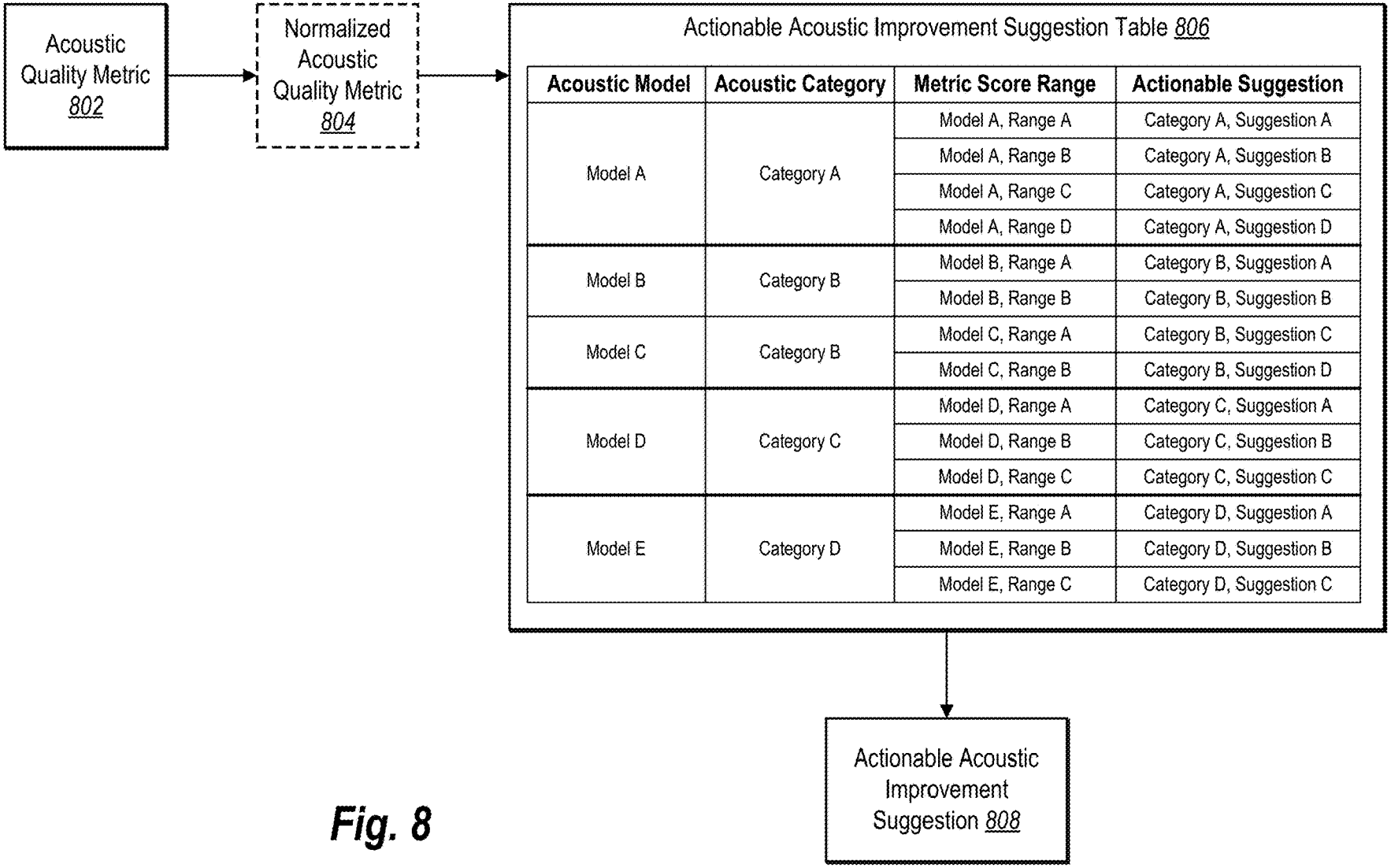

| Acoustic Model | Acoustic Category | Metric Score Range | Actionable Suggestion |
|---|---|---|---|
| Model A | Category A | Model A, Range A | Category A, Suggestion A |
| | | Model A, Range B | Category A, Suggestion B |
| | | Model A, Range C | Category A, Suggestion C |
| | | Model A, Range D | Category A, Suggestion D |
| Model B | Category B | Model B, Range A | Category B, Suggestion A |
| | | Model B, Range B | Category B, Suggestion B |
| Model C | Category B | Model C, Range A | Category B, Suggestion C |
| | | Model C, Range B | Category B, Suggestion D |
| Model D | Category C | Model D, Range A | Category C, Suggestion A |
| | | Model D, Range B | Category C, Suggestion B |
| | | Model D, Range C | Category C, Suggestion C |
| Model E | Category D | Model E, Range A | Category D, Suggestion A |
| | | Model E, Range B | Category D, Suggestion B |
| | | Model E, Range C | Category D, Suggestion C |

*Fig. 8*

VOICE RECORDINGS USING ACOUSTIC QUALITY MEASUREMENT MODELS AND ACTIONABLE ACOUSTIC IMPROVEMENT SUGGESTIONS

BACKGROUND

Recent years have witnessed a rapid increase in the field of digital audio recordings. Indeed, advances in both hardware and software have increased the availability of capturing, consuming, and distributing digital audio recordings. For instance, a large number of individuals have consistent access to computing devices (e.g., a smartphone or tablet) that have hardware capable of capturing digital audio at any time or location. Further, many other modern computing devices (e.g., servers, laptops, and desktops) include improved hardware for capturing and recording digital audio. In addition, modern computing devices include a variety of software packages and applications that provide for recording, editing, and distributing digital audio recordings. For example, many individuals create, edit, and share podcasts (i.e., digital audio recordings) using one or more of these modern computing devices.

Despite these and other advances, many technological issues still remain with regard to conventional systems, particularly in the area of capturing high-quality digital audio recordings. For example, individuals that use conventional systems are often unaware of recording guidelines, lack aural listening skills necessary to detect audio mistakes, and/or believe they cannot achieve higher-quality recordings with their recording configuration. Further, many individuals that use conventional systems to capture digital audio recordings produce low-quality recordings without any indication of how the quality of their digital audio recordings could be improved. These low-quality recordings are often a result of conventional audio capturing systems facing technical problems with respect to accuracy, efficiency, and flexibility of operation.

To illustrate, as an example of inaccuracy, many conventional systems use imprecise approaches to determine the quality of digital audio recordings. For instance, some conventional systems utilize rudimentary approaches that measure basic acoustic metrics. These approaches, however, fail to accurately identify or detect root causes of digital audio recording quality concerns.

In failing to accurately address digital audio recording quality concerns, conventional systems also lead to significant waste of time and computer resources. For example, conventional systems often lead to users providing a variety of user interactions with hardware recording devices or software interface elements in an attempt to identify or address audio recording quality problems. This approach leads to unnecessary and excessive user interactions and computational overhead.

Some systems seek to address accuracy concerns with complex environment testing procedures, but these approaches only exacerbate efficiency concerns. For example, many conventional systems are unable to achieve a high level of accuracy without requiring intrusive testing procedures, which are difficult to implement and require expensive testing equipment to measure. In addition, some conventional systems struggle to accurately determine the quality of a digital audio recording without first analyzing specific baseline samples that are difficult and time-consuming to obtain.

Moreover, conventional systems have significant shortfalls in relation to flexibility of operation. As mentioned above, many conventional systems are complex and sophisticated and thus, require training, skill, and experience to operate. Additionally, many conventional systems cannot operate without using expensive complicated software, intrusive testing procedures, or expensive testing equipment. Accordingly, the rigid training and equipment requirements of conventional systems often exclude novices, hobbyists, and other non-experts. Further, many conventional systems are inflexible and rigid in applying a particular limited approach to determine the quality of digital audio recordings (e.g., measuring volume).

These, along with additional problems and issues exist in conventional systems with respect to improving the quality of digital audio recordings.

BRIEF SUMMARY

Embodiments of the present disclosure provide benefits and/or solve one or more of the foregoing or other problems in the art with systems, non-transitory computer-readable media, and methods for improving the quality of digital audio recordings utilizing multiple acoustic quality measurement models. For example, the disclosed systems of the present disclosure utilize multiple acoustic quality measurement models to determine a range of acoustic quality metrics for one or more digital audio recordings. Then, utilizing the acoustic quality metrics, the disclosed systems can determine various actionable acoustic improvement suggestions for improving the quality of the digital audio recording. In addition, the disclosed systems can generate and present an interactive graphical user interface that selectively provides actionable acoustic improvement suggestions to the user as the user interacts with the acoustic quality metrics. The disclosed systems can flexibly utilize non-intrusive tests (e.g., measured directly from speech) to accurately pinpoint the root cause of technical quality issues and efficiently improve digital audio recordings.

The following description sets forth additional features and advantages of one or more embodiments of the disclosed systems, computer media, and methods.

BRIEF DESCRIPTION OF THE DRAWINGS

The detailed description provides one or more embodiments with additional specificity and detail through the use of the accompanying drawings, as briefly described below.

FIG. 8 illustrates determining actionable acoustic improvement suggestions for a digital audio recording utilizing acoustic quality metrics in accordance with one or more embodiments.

DETAILED DESCRIPTION

Figure 1:
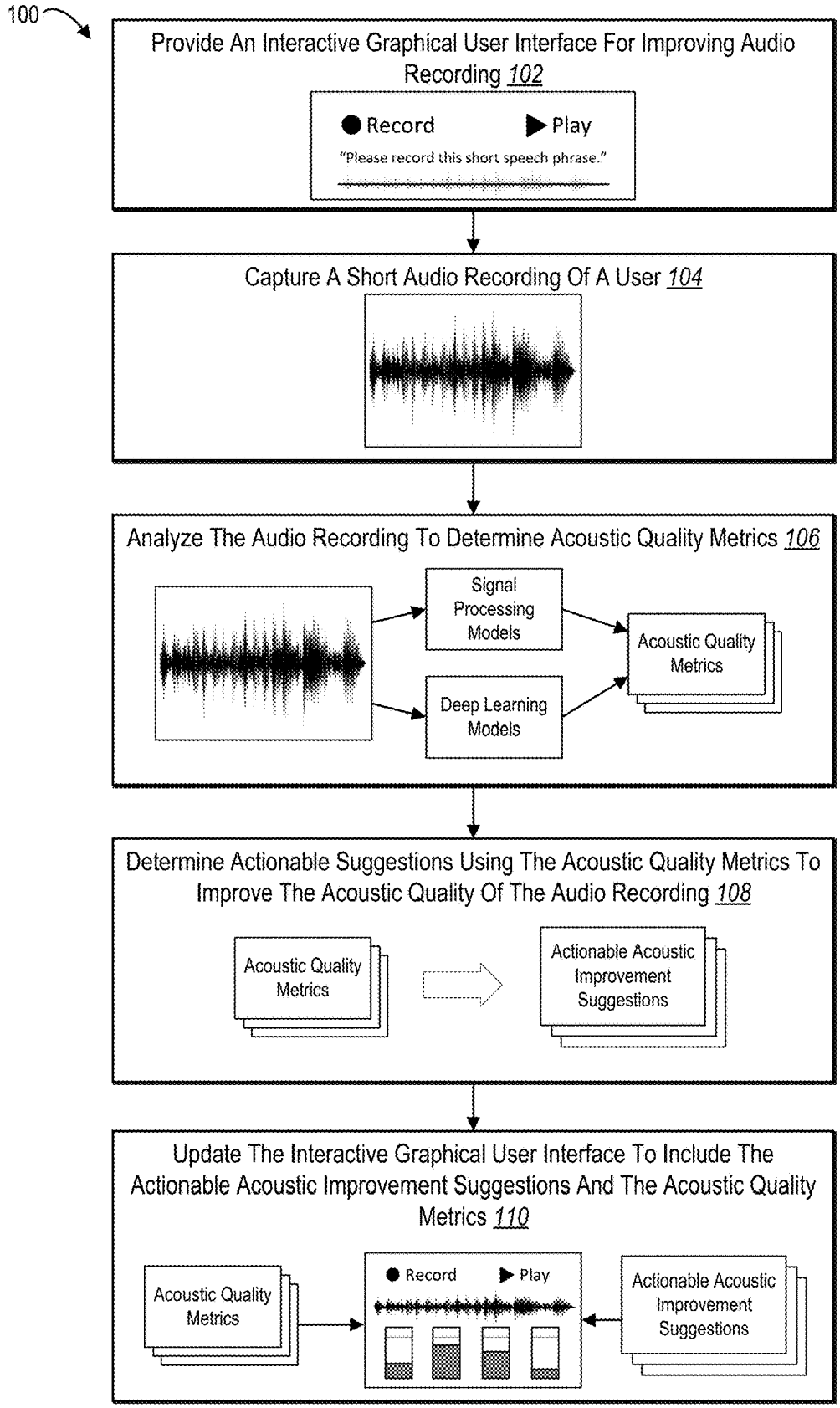
FIG. 1 illustrates an overview diagram of providing actionable acoustic improvement suggestions within an interactive graphical user interface in accordance with one or more embodiments.

This disclosure describes one or more embodiments of an acoustic improvement system that accurately and efficiently determines and provides actionable acoustic improvement suggestions to users for digital audio recordings via an interactive graphical user interface based on various acoustic quality measurement models. For example, the acoustic improvement system can assist in creating high-quality digital audio recordings by providing a combination of acoustic quality metrics and actionable acoustic improvement suggestions within the interactive graphical user interface customized to each digital audio recording. Furthermore, the acoustic improvement system can generate acoustic quality metrics and actionable acoustic improvement suggestions utilizing non-intrusive tests measured directly from digital speech recordings. Accordingly the acoustic improvement system can accurately identify the underlying causes of digital audio recording quality issues with widely-available hardware and digital inputs to flexibly and efficiently improve the quality of digital audio recordings.

To illustrate, in one or more embodiments, the acoustic improvement system can identify audio input (e.g., a digital audio recording) of a user. Based on the audio input, the acoustic improvement system can determine multiple acoustic quality metrics corresponding to different acoustic quality categories by utilizing multiple acoustic quality measurement models. In addition, the acoustic improvement system can utilize the acoustic quality metrics to determine key actionable acoustic improvement suggestions from a larger set of actionable acoustic improvement suggestions. Further, the acoustic improvement system can provide one or more of the key actionable acoustic improvement suggestions, on-demand, within an interactive graphical user interface along with the acoustic quality metrics.

As mentioned above, the acoustic improvement system can capture digital audio recordings. In many embodiments, the acoustic improvement system utilizes an acoustic interactive graphical user interface to guide a user in capturing and listening to digital audio recordings. For example, the acoustic improvement system can utilize a microphone integrated into or connected to a client device associated with the user to capture digital audio recordings made by the user.

The acoustic improvement system can analyze a captured audio recording utilizing various acoustic quality measurement models to generate different acoustic quality metrics. Acoustic quality measurement models can include signal processing models and deep learning models. For deep learning models, in some embodiments, the acoustic improvement system generates a neural network with architecture customized to efficiently determine corresponding acoustic quality metrics. For example, in some embodiments the acoustic improvement system applies a direct-to-reverberant ratio model, a reverberation time model, a voice activity detection model, a signal-to-noise ratio model, a perceived loudness model, a peak loudness model, a glitch detection model, a dropout detection model, a noise handling model, and a pop noise detection model.

These models can generate different acoustic quality metrics and, in some embodiments, the acoustic improvement system combines the results of these models to generate a set of acoustic quality metrics. For instance, the acoustic improvement system can utilize different combinations of the acoustic quality measurement models to generate a microphone distance metric, a loudness metric, a room characteristics metric, and a noise level metric. Further, in some embodiments, the acoustic improvement system can scale and/or combine the acoustic quality metrics to determine an overall audio quality score.

In some embodiments, the acoustic improvement system pre-processes a digital audio recording to identify significant portions of the recording before applying the acoustic quality measurement models. For example, the acoustic improvement system utilizes a voice activity detection model to isolate portions of the digital audio recording that include speech. Then, using the speech portions, the acoustic improvement system can utilize the acoustic quality measurement models to more accurately determine the acoustic quality metrics. In this manner, the acoustic improvement system can reduce the overall computing costs of client devices by not processing or analyzing immaterial portions of digital audio recordings across multiple acoustic quality measurement models.

Upon determining acoustic quality metrics, the acoustic improvement system can determine actionable suggestions from the acoustic quality metrics. For example, in one or more embodiments, the acoustic improvement system compares the one or more acoustic quality metrics for an acoustic quality category to a set of actionable acoustic improvement suggestions to determine one or more actionable suggestions corresponding to the acoustic quality metrics. To illustrate, based on a particular room characteristics metric, the acoustic improvement system can generate an actionable acoustic improvement suggestion to modify one or more characteristics of the room environment.

As mentioned above, the acoustic improvement system can provide an interactive graphical user interface via a client device that includes actionable acoustic improvement suggestions (or simply "actionable suggestions") and acoustic quality metrics. In various embodiments, the actionable suggestions and the acoustic quality metrics are divided by acoustic quality category, such as microphone distance, loudness, room characteristics, and noise level. Then, when a user selects one of the acoustic quality metrics corresponding to a given acoustic quality category, the acoustic improvement system can dynamically provide the user with a targeted actionable suggestion that indicates how the digital audio recording can be improved for the given acoustic quality category.

Using the interactive graphical user interface, users can track progression and improvement (e.g., akin to seeing grades on report cards) as they optimize their recording environment using the acoustic improvement system. For example, the acoustic improvement system can provide a short speech phrase that includes various speech characteristics, such as plosive and sibilance sounds. A user can provide multiple test samples of the short speech phrase, making adjustments to the recording environment between each recording, to create an optimal (or near optimal) recording environment that yields a high-quality digital audio recording. In this manner, the acoustic improvement system can assist in improving a recording environment to capture improved digital audio recording (e.g., a podcast, an audio or video lecture, or an audio call).

As previously mentioned, the acoustic improvement system can provide numerous advantages, benefits, and practical applications over conventional systems. In particular, the acoustic improvement system can generate high-quality digital audio recordings via an interactive graphical user interface that provides actionable acoustic improvement suggestions customized to client devices and corresponding acoustic environments. For example, the acoustic improvement system can improve implement computing devices with regard to accuracy, efficiency, and flexibility of operation.

Regarding accuracy, the acoustic improvement system can utilize precise approaches to determine the quality of digital audio recordings. For example, the acoustic improvement system can utilize customized models to determine higher-quality acoustic metrics. For instance, as mentioned above, the acoustic improvement system can utilize deep learning acoustic quality measurement models and other models to achieve accurate acoustic quality metrics. In addition, the acoustic improvement system can ignore immaterial segments of digital audio recordings that are unimportant and often noisy. As a result, the acoustic improvement system can determine more accurate acoustic quality metrics, which in turn, leads to more accurate actionable suggestions, higher-quality digital audio recordings, and/or better recording environments.

In addition, the acoustic improvement system can improve efficiency relative to conventional systems. For example, by utilizing an interactive graphical user interface that includes acoustic quality metrics and actionable acoustic improvement suggestions, the acoustic improvement system can significantly reduce the time and user interactions needed to improve an acoustic environment and corresponding digital audio recordings. Indeed, the acoustic improvement system can provide specific actionable suggestions in relation to particular acoustic quality metrics that quickly alleviate quality issues with regard to digital audio recordings.

Moreover, the acoustic improvement system can accurately identify acoustic quality metrics and corresponding actionable suggestions without needing intrusive testing procedures and particular baseline samples. For context, intrusive measurements of conventional systems largely require the use of a specialized probe device or signal to study a recording environment. The acoustic improvement system can determine accurate measurement metrics using a digital audio recording of speech via a microphone of a client computing device.

Additionally, the acoustic improvement system can provide improved flexibility over conventional systems. For instance, the acoustic improvement system can provide an intuitive and easy-to-use interactive graphical user interface applicable to various skill and experience levels. Further, the acoustic improvement system utilizes a wide range of acoustic quality measurement models that can pinpoint a variety of root causes of audio quality issues. Accordingly, a wide range of users can utilize the acoustic improvement system to identify audio quality problems as well as follow acoustic actionable suggestions to quickly improve those problems. Further, the acoustic improvement system operates without the need for a rigid set of hardware, testing equipment, or intrusive testing procedures.

As illustrated by the foregoing discussion, the present disclosure utilizes a variety of terms to describe features and advantages of the acoustic improvement system. For example, as used herein, the term "audio" refers generally to captured and/or reproducible sound. For instance, audio may include sound captured in a digital audio recording. In various embodiments, audio may include speech as well as non-speech sounds regardless of the sound source (e.g., human, computer, instrument, synthetic, or nature).

The terms, "digital audio recording," "audio recording," or "audio input" may refer to data that includes audio recorded over time. For example, a microphone or another type of audio capturing hardware that corresponds to a client device may capture and record audio as a digital audio recording. Also, digital audio recording can be combined or split to form new digital audio recordings. Further, digital audio recordings can be stored and/or transmitted as audio files for playback on audio playback devices. In some embodiments, a digital audio recording is processed and/or streamed in real-time with or without storing the captured audio in an audio file.

The term "acoustic quality metrics" refers to a quantifiable measure of one or more audio characteristics in a digital audio recording. For instance, the acoustic improvement system can utilize acoustic quality measurement models (e.g., a suite of acoustic tests) to analyze the audio in a digital audio recording to determine acoustic quality metrics. Examples of acoustic quality metrics include, but are not limited to, a microphone distance metric, a loudness metric, a room characteristics metric, and a noise level metric.

As used herein, the term "acoustic quality measurement model" refers to a computer-implemented algorithmic method utilized to analyze a digital audio recording. As mentioned above, an acoustic quality measurement model can calculate, estimate, and/or determine one more acoustic quality metrics of a digital audio recording. An acoustic quality measurement model can include signal processing models as well as a deep learning model. Examples of acoustic quality measurement model include, but are not limited to, a direct-to-reverberant ratio (DRR) model, a reverberation time model, a voice activity detection (VAD) model, a signal-to-noise ratio (SNR) model, a perceived loudness model, a peak loudness model, a glitch detection model, a dropout detection model, a handling noise model, or a pop noise detection model.

The term "actionable acoustic improvement suggestions" (or simply "actionable suggestions") refers to a recommendation provided to a user to improve the quality of a digital audio recording and/or the recording environment of the user. Often, an actionable acoustic improvement suggestion is text-based and presented in connection with an interactive graphical user interface. However, the acoustic improvement system can present an actionable suggestion via other channels, such as through graphics or sound. This includes, for example, suggestions from a virtual digital assistant via text-to-speech synthesizer (e.g., the virtual digital assistant can provide one or more verbal actionable suggestions to a user that indicate how the user can best improve the audio quality of a digital audio recording). Further, actionable suggestions are commonly presented at the time of capturing a digital audio recording, however, actionable suggestions could correspond to a previously captured digital audio recording. Furthermore, suggestions can be associated with specific events in time, allowing a user to view when, where, and why audio quality was degraded from a given recording.

In addition, the term "machine-learning model" refers to a computer representation that can be tuned (e.g., trained) based on inputs to approximate unknown functions. In particular, a machine-learning model can include a model that utilizes algorithms to learn from, and make predictions on, known data by analyzing the known data to learn to generate outputs that reflect patterns and attributes of the known data. For instance, machine-learning models can include but is not limited to, reverberation time models (e.g., T60), direct-to-reverberant ratio (DRR) models, signal-to-noise ratio (SNR) models, voice activity detection (VAD) models, perceived loudness models, peak loudness models, glitch detection models, dropout detection models, pop noise detection models, or handling noise models. In addition, the term machine-learning model can include linear regression models, logistical regression, random forest models, support vector machines (SVG) models, neural networks, or decision tree models. Thus, a machine-learning model can make high-level abstractions in data by generating data-driven predictions or decisions from the known input data.

As used herein, the term "neural network" refers to a machine learning model that can be tuned (e.g., trained) based on inputs to approximate unknown functions. In particular, the term neural network can include a model (e.g., a deep learning model) of interconnected neurons that communicate and learn to approximate complex functions and generate outputs based on a plurality of inputs provided to the model. For instance, the term neural network includes an algorithm (or set of algorithms) that implements deep learning techniques that utilize a set of algorithms to model high-level abstractions in data using supervisory data to tune parameters of the neural network. Examples of neural networks include a recurrent neural network (RNN), graph neural network, generative adversarial neural network (GAN), convolutional neural network (CNN), Region-CNN (R-CNN), Faster R-CNN, Mask R-CNN, and single-shot detect (SSD) networks.

Referring now to the figures, FIG. 1 illustrates an overview diagram of providing actionable acoustic improvement suggestions within an interactive graphical user interface in accordance with one or more embodiments. As shown, FIG. 1 includes a series of acts 100 for providing actionable suggestions via the interactive graphical user interface. As shown, the series of acts 100 includes an act 102 of the acoustic improvement system providing an interactive graphical user interface for improving the audio recording. For example, the acoustic improvement system generates the interactive graphical user interface (or simply "interactive interface") and causes a client device associated with a user to display the interactive interface in connection with the user optimizing the quality of their digital audio recordings and/or recording environment. Examples of the interactive interface are provided below in connection with FIGS. 2A-2C.

As mentioned previously, the interactive interface can capture and test digital audio recordings. For example, the interactive interface can include various graphical elements to capture a short digital audio recording, display a visualization of captured recordings (e.g., audio waveforms), and/or playback captured recordings. To illustrate, the series of acts 100 in FIG. 1 includes an act 104 of the acoustic improvement system capturing a short audio recording of a user. In some embodiments, the acoustic improvement system provides the user with a sentence or phrase or word to the user to speak when capturing the short digital audio recording.

As shown, the series of acts 100 includes an act 106 of the acoustic improvement system analyzing the audio recording to determine acoustic quality metrics. For instance, in one or more embodiments, the acoustic improvement system performs a suite of acoustic unit tests to determine various acoustic quality metrics. For example, the acoustic improvement system utilizes various signal processing models and deep learning models to determine acoustic quality metrics for the captured digital audio recording. Additional detail regarding generating acoustic quality metrics is provided below in connection with FIGS. 6A-7.

FIG. 1 also shows that the series of acts 100 includes an act 108 of the acoustic improvement system determining actionable suggestions (i.e., actionable acoustic improvement suggestions) using the acoustic quality metrics to improve the quality of the audio recording. For instance, the acoustic improvement system utilizes the acoustic quality metrics to determine deficiencies and/or areas of improvement with respect to the captured digital audio recording. Based on these deficiencies, the acoustic improvement system identifies actions that the user can perform to improve audio quality. Additional detail regarding determining actionable suggestions is provided with respect to FIG. 8.

As shown, the series of acts 100 includes an act 110 of the acoustic improvement system updating the interactive graphical user interface to include the actionable acoustic improvement suggestions and the acoustic quality metrics. For instance, in various embodiments, upon generating the acoustic quality metrics and determining the actionable suggestions, the acoustic improvement system can present these metrics and suggestions within the interactive interface. For example, the acoustic improvement system can initially provide the acoustic quality metrics within the interactive interface upon analyzing the captured digital audio recording and determining the acoustic quality metrics. Then, upon detecting user-interaction with a given acoustic quality metric within the user interface, the acoustic improvement system can update the interactive interface to display one or more actionable suggestions corresponding to the given acoustic quality metric. Examples of providing actionable suggestions in an interactive interface are provided below in connection with FIGS. 3A-4C.

Figure 2A:
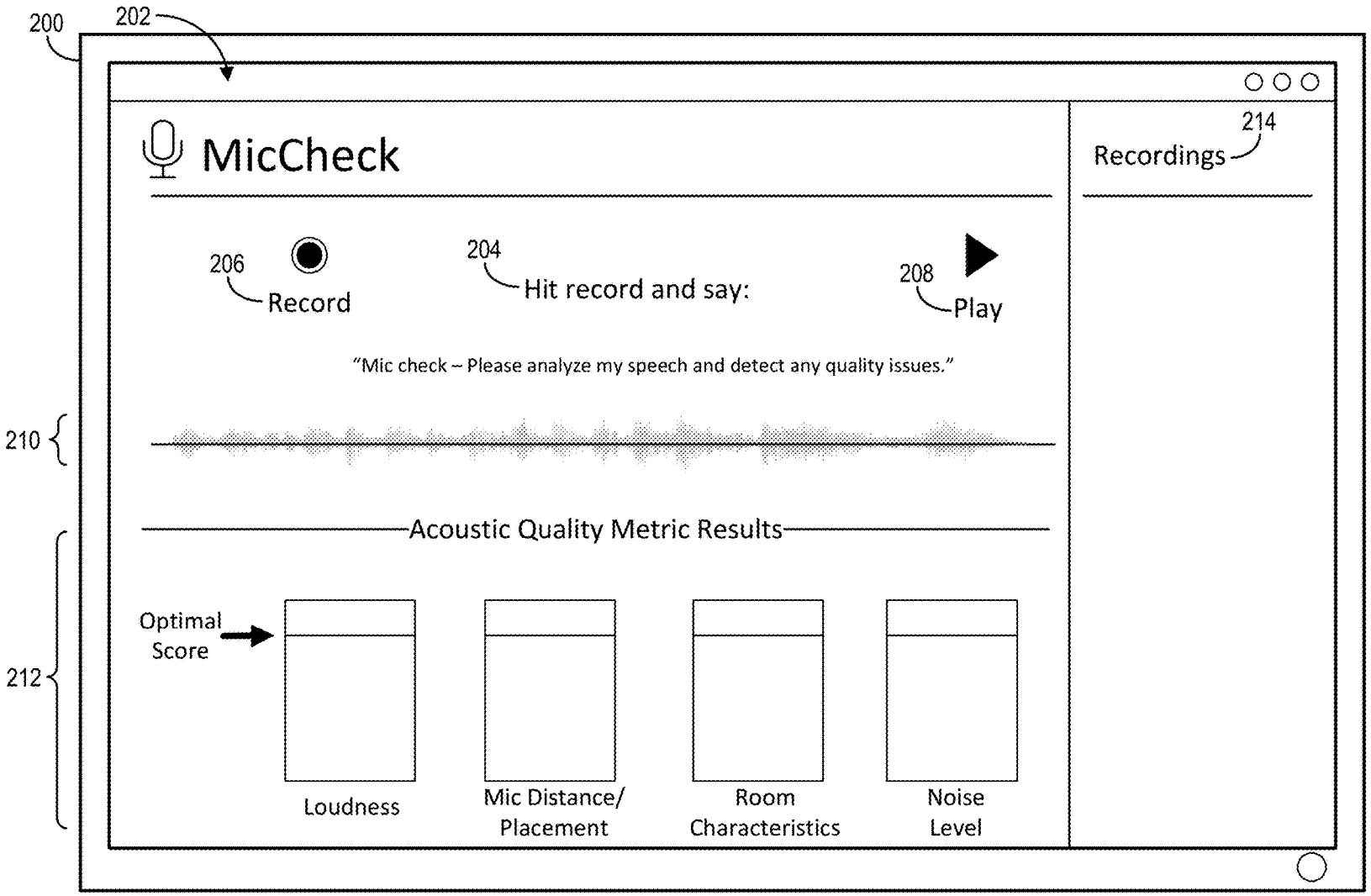
FIGS. 2A-2C illustrate graphical user interfaces for capturing digital audio recordings for acoustic quality measurement testing in accordance with one or more embodiments.
Figure 2B:
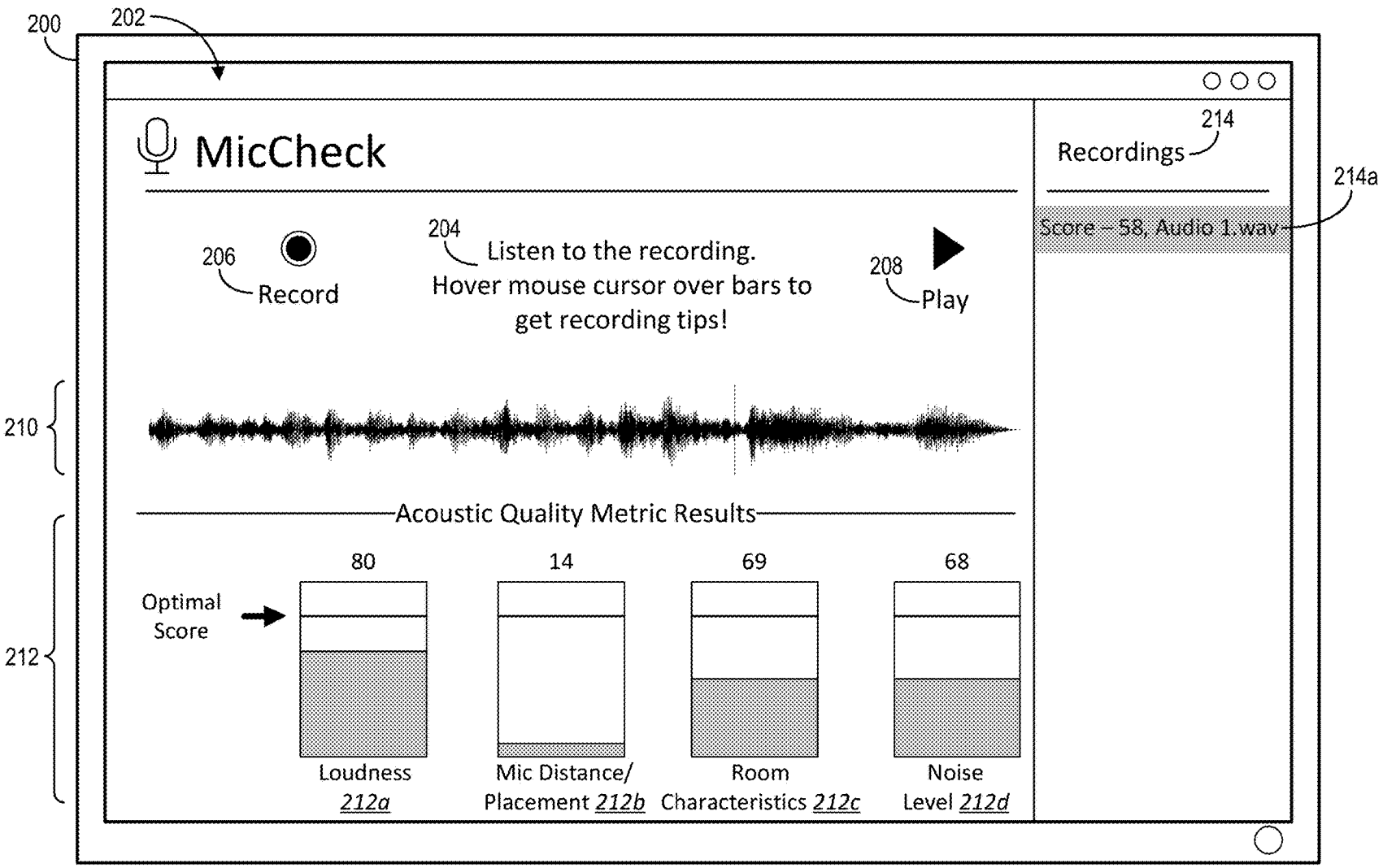
Figure 2C:
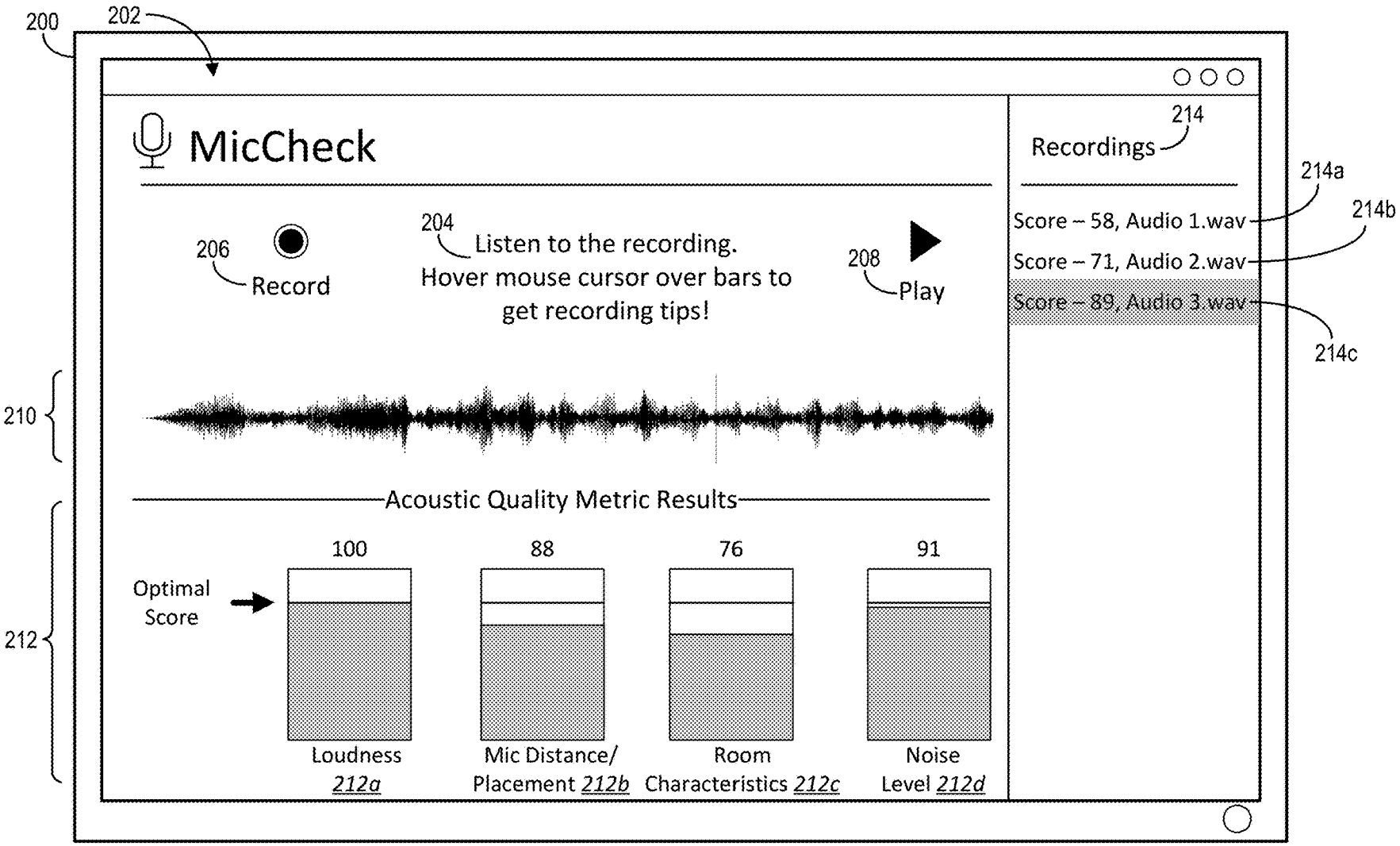

As mentioned above, FIGS. 2A-2C provide examples of capturing a short digital audio recording. In particular, FIGS. 2A-2C illustrate graphical user interfaces of capturing digital audio recordings for acoustic quality measurement testing in accordance with one or more embodiments. As shown in FIGS. 2A-2C, a client device 200 includes an interactive graphical user interface 202 (or simply "interactive interface 202") having various graphical elements. The graphical elements can include text, graphics, animations, video, or other types of graphical elements.

To illustrate, the interactive interface 202 in FIGS. 2A-2C includes an instructions element 204, a selectable record element 206, a selectable playback element 208, a waveform element 210, and multiple interactive elements corresponding to acoustic quality metrics 212 (e.g., acoustic quality metric results). In addition, in some embodiments, the interactive interface 202 includes a recordings list 214. In some embodiments, the acoustic improvement system provides the recordings list 214 as a separate and/or additional graphical user interface.

As mentioned above, the interactive interface 202 includes an instructions element 204. As shown in FIG. 2A, the instructions element 204 provides information that guides a user in the process of capturing and testing the audio quality of a digital audio recording. For example, the instructions element 204 includes directions for the user to select the selectable record element 206 and recite the provided short speech phrase.

As shown, the selectable record element 206 includes a graphic (e.g., a circle) and corresponding text. Upon selecting the selectable record element 206, the acoustic improvement system can begin to record audio provided (e.g., spoken) by the user. In some embodiments, the selectable record element 206 changes in appearance in response to being selected. For example, upon detecting the user selecting the selectable record element 206, the acoustic improvement system updates the selectable record element 206 to show a stop recording graphic (e.g., a square) and/or updates the text to "Stop Recording." Upon being selected again, the acoustic improvement system can change the selectable record element 206 back to the original graphics and/or text.

In addition, while capturing or recording the short speech phrase from the user, the acoustic improvement system can cause the interactive interface 202 to provide visual feedback to the user. For example, the acoustic improvement system can update the waveform element 210 in real-time as audio is being detected and captured. In this manner, the acoustic improvement system can notify the user of a digital audio recording being actively captured. Further, the acoustic improvement system can include the waveform element 210 of the digital audio recording within the interactive interface 202 upon completing the audio capture.

Moreover, in various embodiments, upon a digital audio recording being captured, the acoustic improvement system can enable the user to hear it by selecting the selectable playback element 208. As with the selectable record element 206, the graphic and/or text of the selectable playback element 208 can change in response to being selected. For example, while the captured digital audio recording is being played back, the graphic of the selectable record element 206 updates to a stop symbol (or a pause symbol) and/or the text updates to "Stop Playback" (or "Pause Playback"). Again, once playback stops, the acoustic improvement system can update the selectable record element 206 back to its default appearance.

As mentioned above, the instructions element 204 shown in FIG. 2A includes a short speech phrase (i.e., "Mic check—Please analyze my speech and detect any quality issues."). In various embodiments, the short speech phrase is a set of words (e.g., at least 2-4 seconds) that enables the acoustic improvement system to test audio characteristics of a digital audio recording. The acoustic improvement system can utilize the speech phrase to test a wide range of audio characteristics of a digital audio recording. For example, the short speech phrase can include words that include plosive sounds (e.g., a popping sound caused by air being suddenly released, such as the words "please" and "detect"). In addition, the short speech phrase can include words that include sibilance sounds (e.g., "shhh" sounds, such as the word "issues"). To improve testing quality and user convenience, the acoustic improvement system can provide a predetermined short speech phrase, as shown. Further, the short speech phrase can include other words that trigger other types of sounds. In this manner, the acoustic improvement system can ensure that the suite of tests applied to the digital audio recording (e.g., the acoustic quality measurement models) will properly test and measure the full range of audio characteristics of the digital audio recording.

In one or more embodiments, upon initiating the acoustic improvement system, loading the interactive interface 202, and/or selecting the selectable record element 206 for the first time, the acoustic improvement system can provide a set of recording guidelines and/or recording best practices to the user. For example, the acoustic improvement system provides one or more separate graphical user interfaces (e.g., a walk-through tutorial) that include information educating the user regarding hardware setup (e.g., volume adjustments, microphone positioning, and speaking techniques) and recording environment setup (e.g., room size and room acoustic property information). In this manner, the acoustic improvement system can ensure that users are provided with basic foundational audio recording principles and/or proper voice recording practices, which will enable users to more quickly achieve high-quality as well as quickly optimize their recording environment (or move to a better recording environment).

To illustrate, FIG. 2B shows the acoustic improvement system updating the interactive interface 202 upon capturing and analyzing a digital audio recording. In particular, FIG. 2B shows the acoustic improvement system updating the waveform element 210 to show an audio waveform of the captured audio recording. In addition, FIG. 2B shows the acoustic improvement system updating the recordings list 214 to include a first audio recording 214*a*.

In addition, the acoustic improvement system updates the interactive elements corresponding to the acoustic quality metrics 212 (i.e., shown as "Acoustic Quality Metric Results") based on analyzing the digital audio recording. As shown, the acoustic quality metrics 212 include four acoustic quality categories. In particular, the acoustic quality metrics 212 include a loudness metric 212*a*, a microphone distance/placement metric 212*b*, a room characteristics metric 212*c*, and a noise level metric 212*d*. While particular acoustic quality metrics are displayed, the acoustic quality metrics 212 can include additional and/or alternative acoustic quality metrics as well as fewer acoustic quality metrics 212 (e.g., two or three acoustic quality metrics).

As shown in FIG. 2B, each of the acoustic quality metrics 212 includes a numeric score as well as a visual indication of the score. Indeed, an acoustic quality metric score indicates the audio quality level for the digital audio recording in a given acoustic quality category. To illustrate, the loudness metric 212*a* includes a score of 80 for the first audio recording 214*a*, indicating that some improvement to one or more loudness characteristics can occur.

In one or more embodiments, a score of 100 indicates an optimal result for a particular acoustic quality category. For example, the acoustic improvement system normalizes and/or scales each of the acoustic quality metrics 212 to a 100 point scale (or another value). Thus, as a score for each of the acoustic quality metrics 212 approaches a numeric score of 100, the overall audio quality of the digital audio recording improves.

Additionally, in some embodiments and depending on the acoustic quality category, a score may exceed 100. For example, in the case of the loudness metric 212*a*, a score below 100 can indicate that the volume is too soft while a score above 100 can indicate that the volume is too loud. Similarly, the score for the microphone distance/placement metric 212*b* may exceed 100 when the microphone is placed too close to a user.

In various embodiments, the acoustic improvement system can combine the scores of the acoustic quality metrics 212. For example, the acoustic improvement system generates an overall acoustic quality score for the digital audio recording by combining the acoustic quality metrics 212. To illustrate, the recordings list 214 shows that the first audio recording 214*a* has an overall acoustic quality score of 58. In one or more embodiments, the acoustic improvement system averages the acoustic quality metrics 212 to determine the overall acoustic quality score. In one or more embodiments, the acoustic improvement system applies a weighted average to the acoustic quality metrics 212, where at least two of the acoustic quality metrics 212 have different weights applied.

In cases where an acoustic quality metric has a score above 100, the acoustic improvement system can subtract the overage for that metric before averaging it with the other acoustic quality metrics 212 (e.g., a score of 115 results in an overage of 15 and a score of 85 (or 100−15=85) for purposes of averaging acoustic quality scores). In alternative embodiments, if one of the acoustic quality metrics 212 is over 100, the acoustic improvement system can assign the combined score to 0 (i.e., zero) or another default value. In some embodiments, the acoustic improvement system ignores acoustic quality metrics with scores over 100.

As mentioned above, a user can interact with the acoustic quality metrics 212 to receive actionable suggestions to improve the score of individual acoustic quality metrics 212 as well as increase the overall score of a digital audio recording. Additional detail regarding the acoustic improvement system providing actionable suggestions is described below in connecting with FIGS. 3A-4C.

Upon applying one or more of the actionable suggestions, the user can re-test/re-record a digital audio recording. To illustrate, the acoustic improvement system detects a user again selecting the selectable record element 206 and again captures a new digital audio recording of the user reading the short speech phrase provided in the instruction element 204. The acoustic improvement system can again analyze the digital audio recording, determine acoustic quality metrics, and update the interactive interface 202 to display the updated acoustic quality metric scores.

In addition, the acoustic improvement system can determine a new overall acoustic quality score (e.g., a number and/or report card grade). To illustrate, FIG. 2C shows multiple digital audio recordings 214*a*-214*d* in the recordings list 214. In particular, the recordings list 214 shows the first audio recording 214*a*, a second audio recording 214*b*, and a third audio recording 214*c*. Further, the third audio recording 214*c* is selected, indicating that it corresponds to the currently displayed acoustic quality metric scores of the acoustic quality metrics 212. In some embodiments, when display space is limited (e.g., on a mobile device with a small display), the acoustic improvement system can first display the overall acoustic quality score without the acoustic quality metrics 212 (e.g., the acoustic quality metrics are displayed on the interactive interface upon the user selecting the overall acoustic quality score).

In one or more embodiments, a user can compare the overall acoustic quality scores as benchmark measurements to track progression and/or improvement (or regression) between audio tests. For example, in response to the detecting a user selection of one of the audio recordings in the recordings list 214, the acoustic improvement system can update the interactive interface to show the individual acoustic quality scores, provide corresponding actionable suggestions, and/or enable the user to playback the previous audio recording. Further, in some embodiments, the acoustic improvement system can enable a user to store and retrieve notes for one or more of the acoustic quality metrics 212 of a previous digital audio recording, which enables the user to more quickly replicate a previous setup or configuration should the user desire to revert to a previous recording environment configuration.

As mentioned above, FIGS. 3A-4C provide additional description regarding the acoustic improvement system providing actionable suggestions (i.e., actionable acoustic improvement suggestions) within the interactive interface 202. In particular, FIGS. 3A-3D correspond to providing an individual actionable suggestion for each of the acoustic quality metrics 212 for a single digital audio recording. FIGS. 4A-4C show how the actionable suggestions change for a single acoustic quality metric (e.g., the microphone distance/placement metric 212*b*) across three different digital audio recordings.

For ease of explanation, FIGS. 3A-4C are described with respect to the client device 200 and the interactive graphical user interface 202 introduced above with respect to FIGS. 2A-2C. For example, the interactive interface 202 includes the instructions element 204, the selectable record element 206, the selectable playback element 208, the waveform element 210, and the interactive elements corresponding to acoustic quality metrics 212.

As recently mentioned above, FIGS. 3A-3D correspond to providing an individual actionable suggestion for each of the acoustic quality metrics 212 for a single digital audio recording. Indeed, FIGS. 3A-3D illustrate graphical user interfaces of providing actionable acoustic improvement suggestions based on different acoustic quality metrics for a single digital audio recording in accordance with one or more embodiments. For example, the first audio recording 214*a* is shown in the recording list 214.

In many embodiments, the acoustic improvement system determines a separate actionable suggestion for each of the acoustic quality metrics 212 based on a corresponding acoustic quality score. For example, each of the acoustic quality metrics 212 correspond to a set of actionable suggestions and the acoustic improvement system selects an actionable suggestion for an acoustic quality metric from the corresponding set based on the acoustic quality score for the acoustic quality metric. Additional detail regarding selecting an actionable suggestion is provided below with respect to FIG. 8.

Figure 3A:
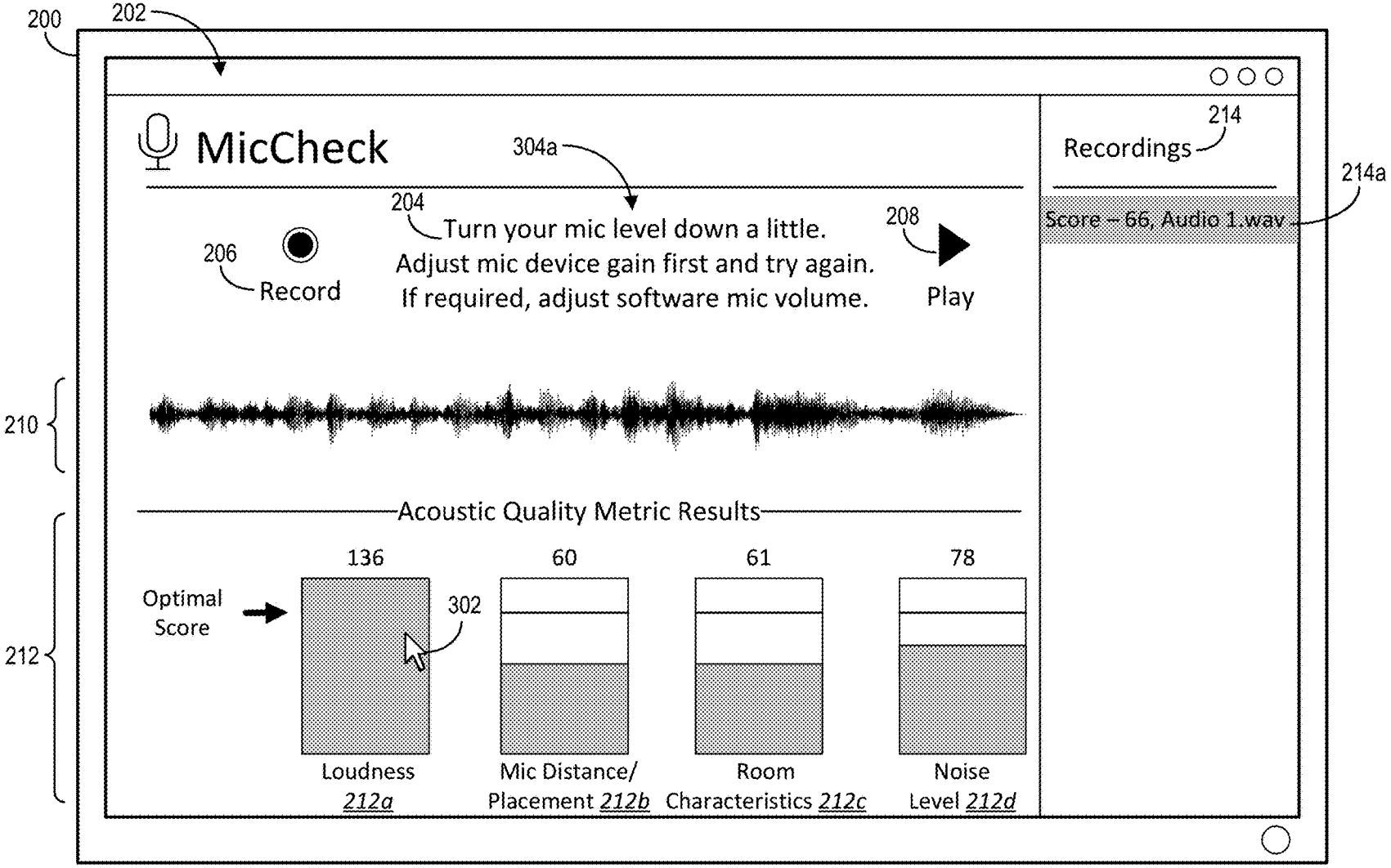
FIGS. 3A-3D illustrate graphical user interfaces for providing actionable acoustic improvement suggestions based on different acoustic quality metrics for a single digital audio recording in accordance with one or more embodiments.
Figure 4A:
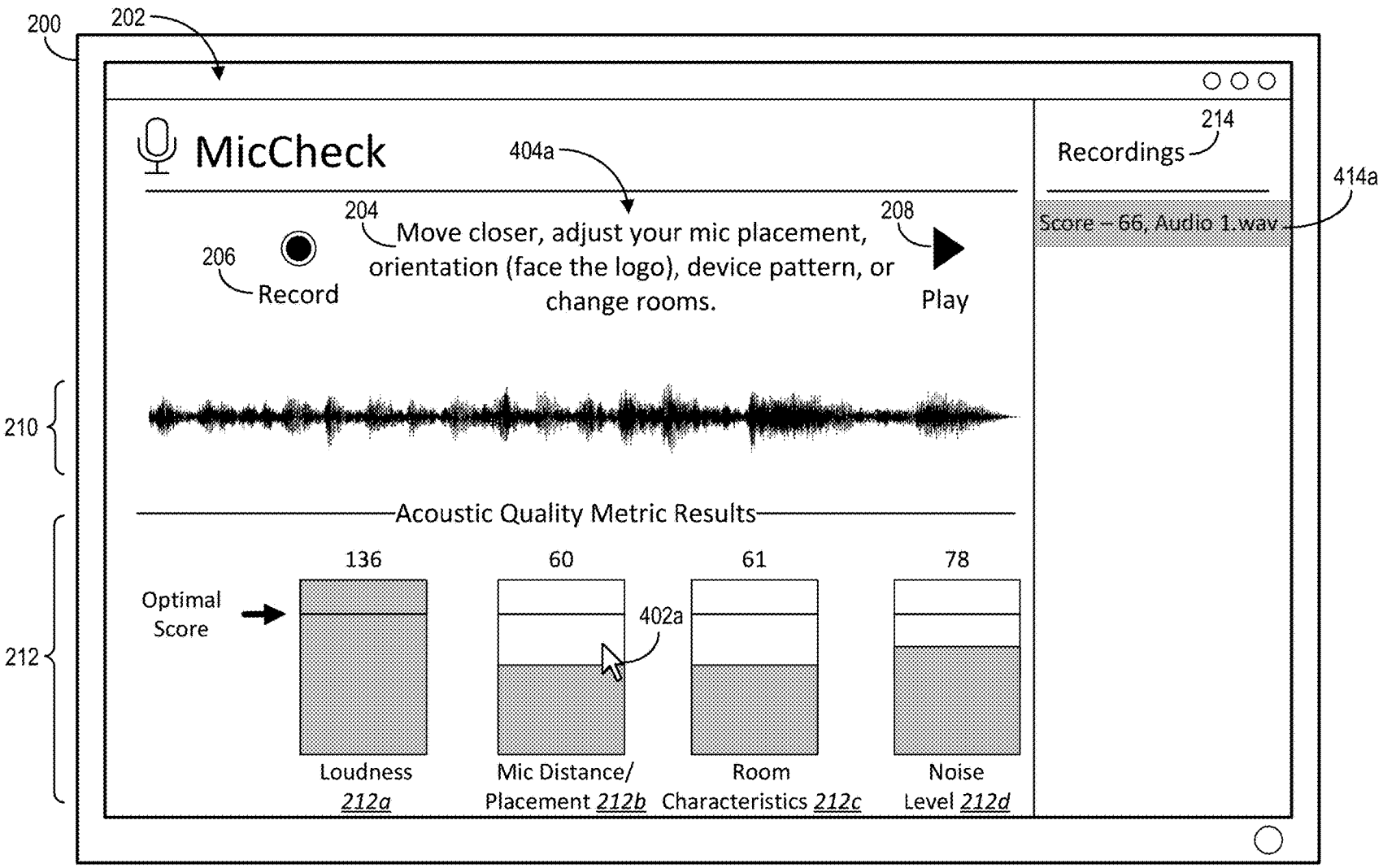
FIGS. 4A-4C illustrate graphical user interfaces for providing different actionable acoustic improvement suggestions based on the same acoustic quality metrics and different digital audio recordings in accordance with one or more embodiments.
Figure 4B:
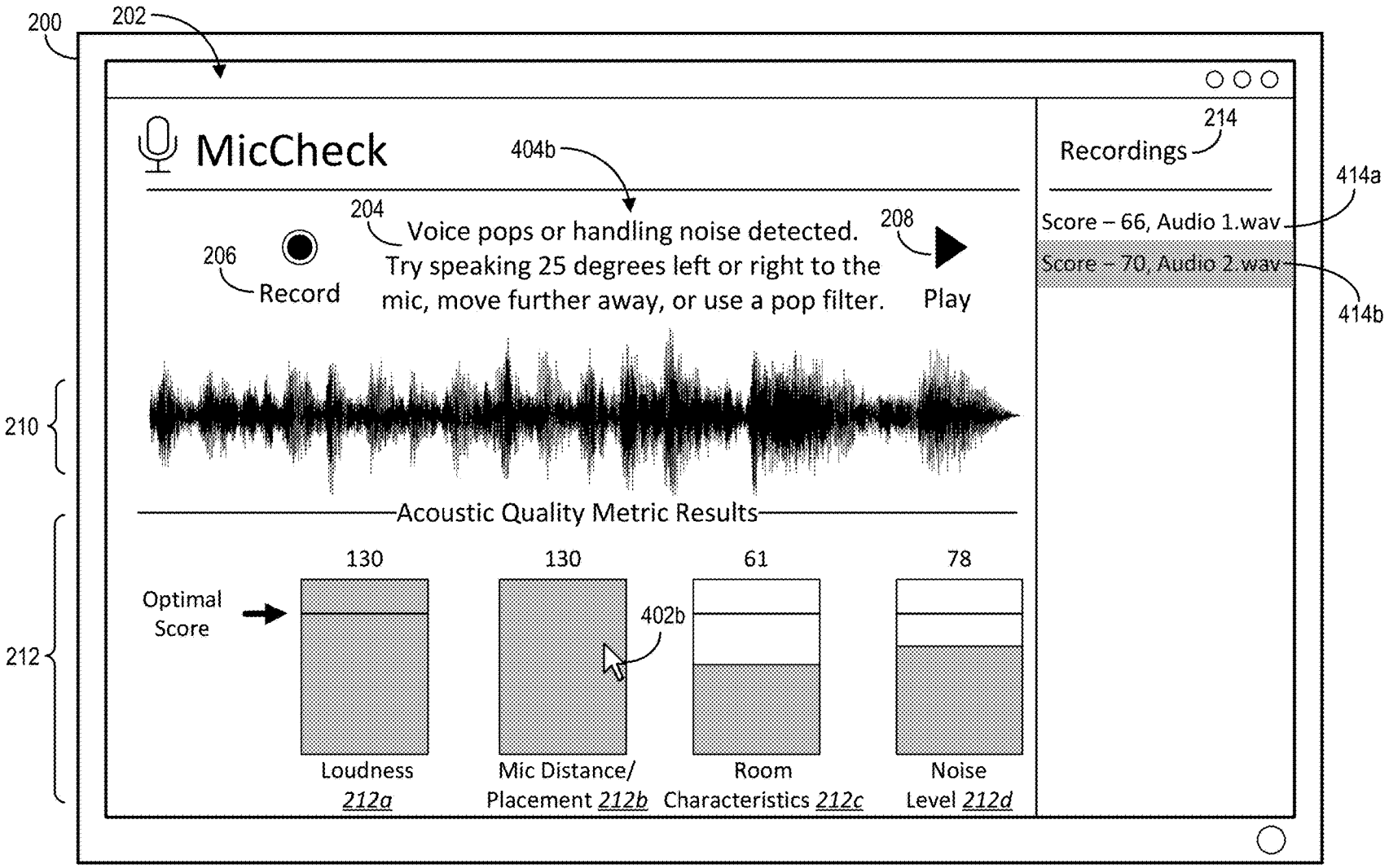
Figure 4C:
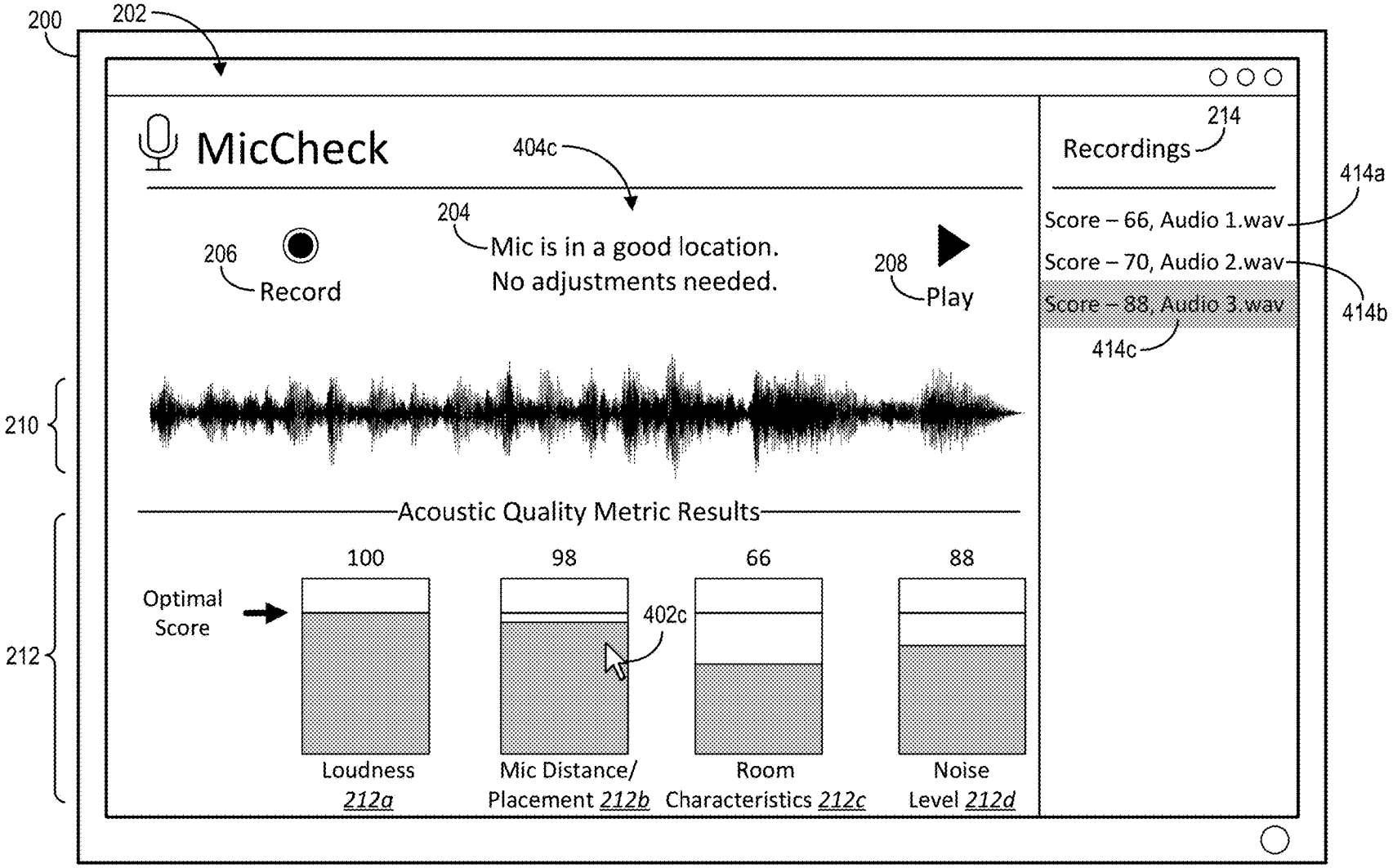

In FIG. 3A, the acoustic improvement system detects a user interaction with the first acoustic quality metric. Indeed, as shown in FIG. 3A, the interactive interface 202 shows a pointer 302 interacting with the loudness metric 212*a*. In one or more embodiments, the pointer 302 corresponds to a computer mouse pointer, touch input from a finger, touch input from a touch input device, or another type of user input. The acoustic improvement system can present an actionable suggestion within the instruction element 204 of the interactive interface based on detecting a user interaction with one of the acoustic quality metrics 212. More specifically, the acoustic improvement system can update the instruction element 204 to display the actionable suggestion corresponding to the loudness metric 212*a* and the acoustic quality score of the loudness metric 212*a*. As shown in FIG. 3A, the acoustic improvement system updates the instruction element 204 to include a first actionable suggestion 304*a* that instructs the user to turn down their microphone level. In additional or alternative embodiments, as mentioned above, the acoustic improvement system can provide the actionable suggestions as graphics, aminations, or other visual elements that visually depict and/or suggest the actionable suggestions.

In various embodiments, the actionable suggestions provided to the user from the acoustic improvement system include actions that can quickly improve both the quality of the digital audio recording as well as optimize the recording environment of the user. As mentioned above, most users poorly judge where audio quality issues occur in an audio recording, let alone, what steps to take to fix those issues. Accordingly, the interactive interface 202 provided by the acoustic improvement system enables users to quickly and efficiently improve the quality of their audio recordings in a simple, easy-to-follow, and intuitive way.

In one or more embodiments, the acoustic improvement system can detect the user interacting with different acoustic quality metrics 212. For example, if the user interacts (e.g., uses the pointer 302 to click, hover, press, hold, or pass over) with another acoustic quality metric, the acoustic improvement system can detect the user interaction and update the interactive interface 202. In particular, the acoustic improvement system can update the instruction element 204 to include the corresponding identified actionable suggestion.

Figure 3B:
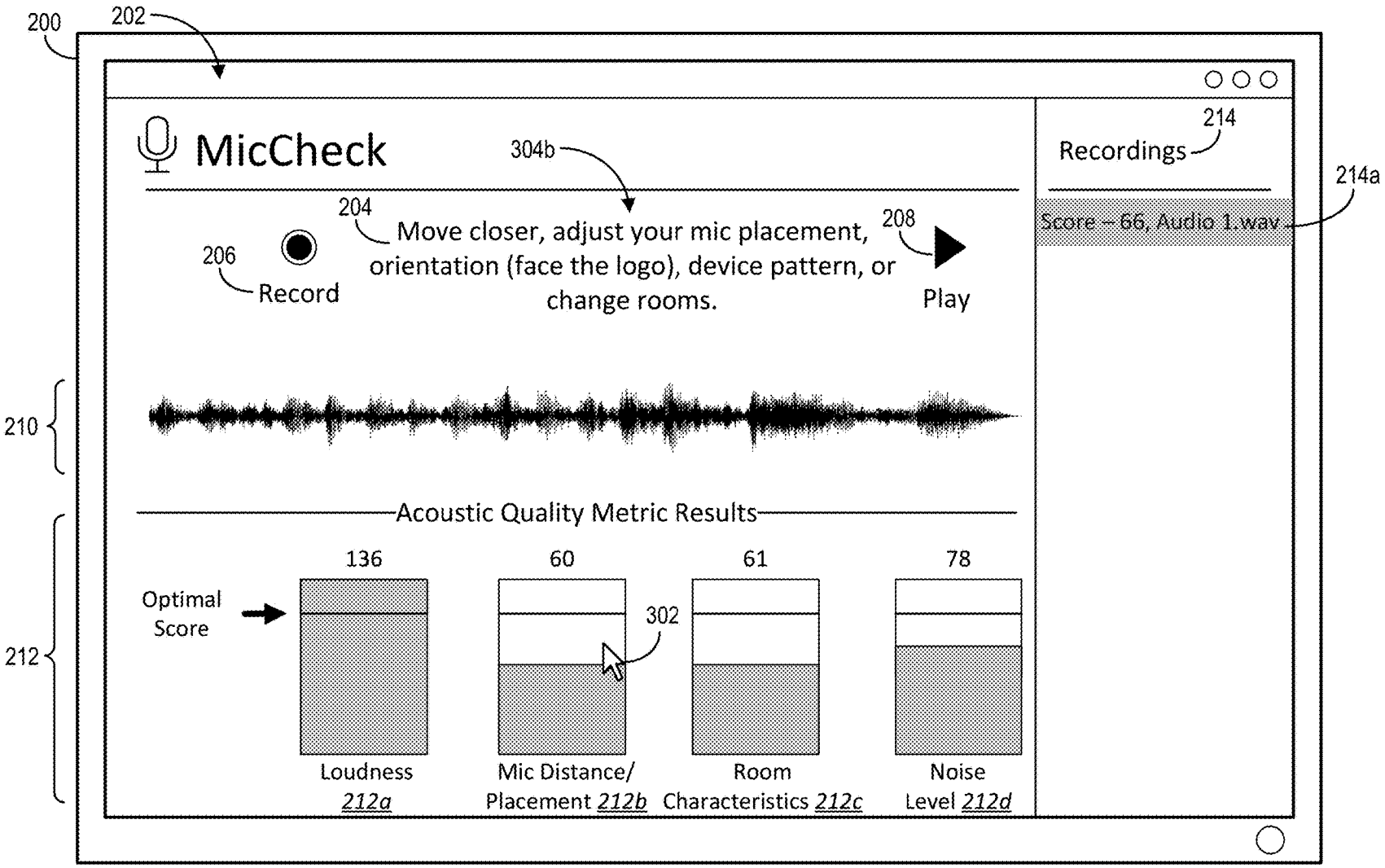

To illustrate, FIG. 3B shows the acoustic improvement system updating the instruction element 204 of the interactive interface 202 in response to detecting a user interaction with the microphone distance/placement metric 212*b*. Indeed, FIG. 3B shows that the pointer 302 is detected in connection with the microphone distance/placement metric 212*b*. FIG. 3B also shows the instruction element 204 providing a second actionable suggestion 304*b* regarding improving the quality of audio recordings based on the user adjusting their position relative to the microphone.

Figure 3C:
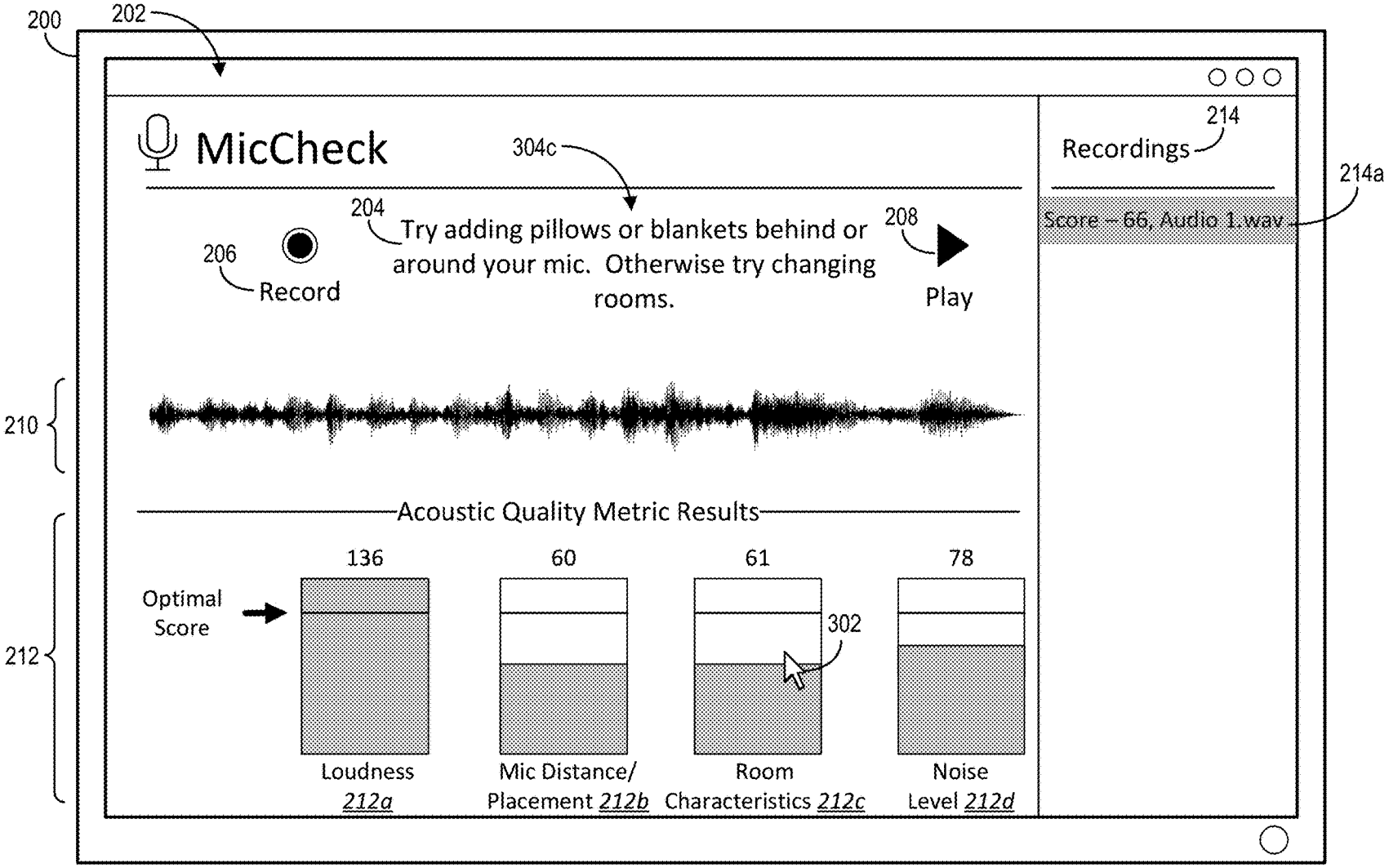
Figure 3D:
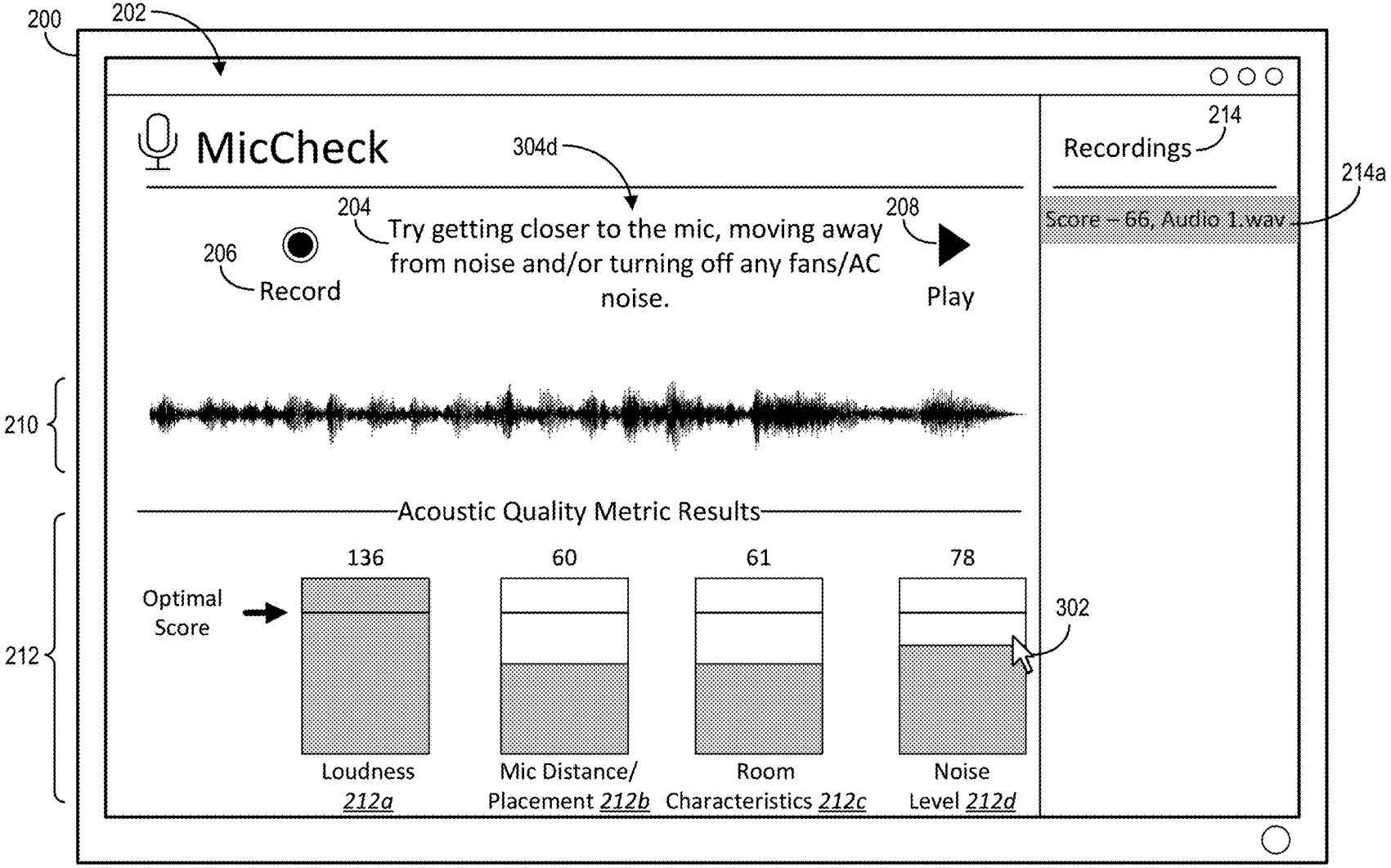

As the user continues to interact with different elements corresponding to the acoustic quality metrics 212, the acoustic improvement system can update the instruction element 204 to display corresponding actionable suggestion. For example, FIG. 3C shows the acoustic improvement system updating the instruction element 204 of the interactive interface 202 to include a third actionable suggestion 304*c* corresponding to the room characteristics metric 212*c* in response to detecting the user interacting with the room characteristics metric 212*c*. Similarly, FIG. 3D shows the acoustic improvement system updating the instruction element 204 of the interactive interface 202 to include a fourth actionable suggestion 304*d* corresponding to the noise level metric 212*d* in response to detecting the user interacting with the noise level metric 212*d*.

As shown in FIGS. 3A-3D, the acoustic improvement system can determine and present different actionable suggestions based on interactions with the different acoustic quality metrics 212. By acting on one or more of the provided actionable suggestions, the user can begin to improve the audio quality of the digital audio recording as well as improve their recording environment (or determine to move to a new recording environment that enables a higher-quality digital audio recording to be captured).

Notably, while these figures show the actionable suggestions within the instruction element 204 of the interactive interface 202, the actionable suggestions can be provided elsewhere in response to detected user interaction. For example, the acoustic improvement system can display one or more of the actionable suggestions in a location other than the instruction element 204 within the interactive interface 202. In some embodiments, the acoustic improvement system shows one or more of the actionable suggestions in a separate user interface, a popup bubble element, or a separate window.

As mentioned above, FIG. 4A-4C show how the actionable suggestions change for a single acoustic quality metric across three different digital audio recordings. Indeed, FIGS. 4A-4C illustrate graphical user interfaces of providing different actionable acoustic improvement suggestions based on the same acoustic quality metrics and different digital audio recordings in accordance with one or more embodiments.

As shown in FIG. 4A, in response to detecting a user input (shown as the pointer 402*a*) with respect to the microphone distance/placement metric 212*b*, the acoustic improvement system can update the instructions element 204 to include a first actionable suggestion 404*a*. As described above, the acoustic improvement system can determine the first actionable suggestion 404*a* based on the acoustic quality score (e.g., 60) of the microphone distance/placement metric 212*b* for the first audio recording 414*a*.

Upon viewing the first actionable suggestion 404*a*, the user can follow the suggested action and move closer to the microphone, change the orientation, change rooms, and/or perform one of the other actionable suggestions of the first actionable suggestion 404*a*. Further, the user can re-test the audio quality of their digital audio recording and/or recording environments utilizing the interactive interface 202, as previously described.

To illustrate, FIG. 4B shows the acoustic improvement system capturing a second audio recording 414*b*, analyzing it, determining updated acoustic quality metrics 212, as well as calculating a new overall acoustic quality score, each of which is previously described. In addition, the acoustic improvement system can identify one or more updated actionable suggestions corresponding to the acoustic quality metrics 212. For example, in response to detecting an additional user input (shown as the pointer 402*b*) with respect to the microphone distance/placement metric 212*b*, the acoustic improvement system can update the instructions element 204 to include a second actionable suggestion 404*b*.

As illustrated in FIG. 4B, the second actionable suggestion 404*b* is different from the first actionable suggestion 404*a* shown in FIG. 4A. Indeed, because the audio characteristics change between the first audio recording 414*a* and the second audio recording 414*b* (represented by the change in acoustic quality scores of the microphone distance/placement metric 212*b*), the acoustic improvement system can determine different actionable suggestions that correspond to the same acoustic quality metric.

In some embodiments, if the acoustic quality scores for the two audio recordings are determined to be similar or within the same range, the acoustic improvement system can provide the same actionable suggestion with the test results of the two audio recordings. For example, if the user fails to move close enough to the microphone between the first audio recording 414*a* and the second audio recording 414*b*, the acoustic improvement system can determine to provide the same actionable suggestion to the user. In this manner, the user can continue to follow the actionable suggestion to increase the quality of their audio recording.

In one or more embodiments, the acoustic improvement system provides an actionable suggestion that indicates an optimal or near-optimal acoustic quality score to the user. To illustrate, FIG. 4C corresponds to the acoustic improvement system capturing a third audio recording 414*c* and shows the acoustic improvement system updating the instructions element 204. As shown, the instructions element 204 updates to include a third actionable suggestion 404*c* in response to detecting a further user input (shown as the pointer 402*c*) with respect to the microphone distance/placement metric 212*b*. For example, the third actionable suggestion 404*c* indicates that the user need not provide additional action with respect to the distance or placement of the microphone.

The user can continue the interaction cycle of providing an audio recording, viewing actionable suggestions determined by the acoustic improvement system, acting on the actionable suggestions until they are satisfied with the scores of the acoustic quality metrics 212 and/or the overall acoustic quality score of an audio recording. In some embodiments, upon being satisfied, the user can utilize the acoustic improvement system, an audio recording system, or another program, application, or system to capture a full-length digital audio recording (e.g., a podcast or an audio or video lecture). Further, in some embodiments, the user can utilize the optimized recording environment for audio captured in real-time or non-recorded audio (e.g., a digital phone call or a video conference).

Figure 5:
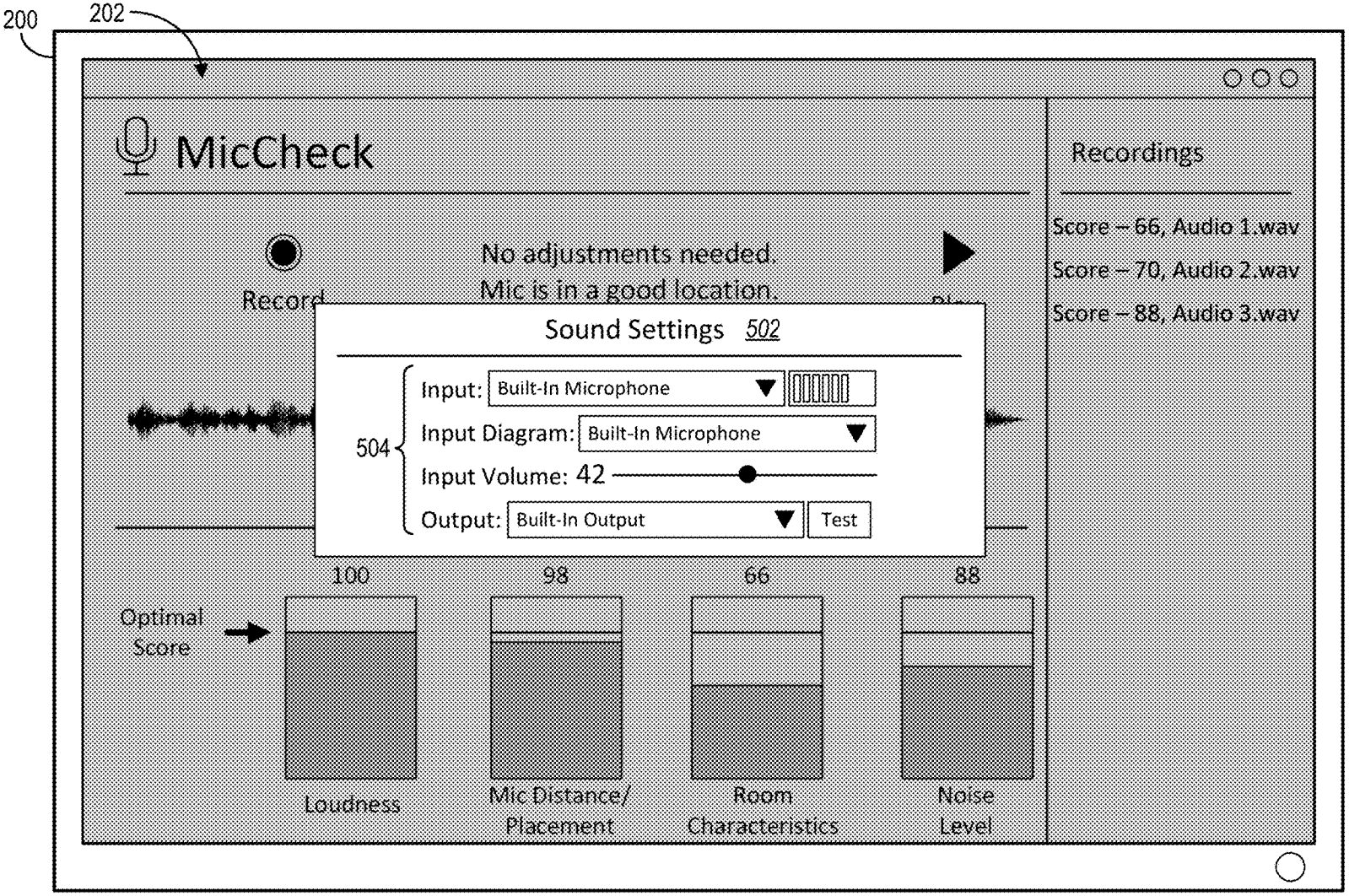
FIG. 5 illustrates a graphical user interface for modifying recording parameters based on an actionable acoustic improvement suggestion in accordance with one or more embodiments.

FIG. 5 shows a graphical user interface for modifying recording parameters based on one or more actionable acoustic improvement suggestions in accordance with one or more embodiments. As shown, FIG. 5 includes a sound settings user interface 502 on the client device 200 over the interactive interface 202, which is described above. The sound settings user interface 502 includes values sound setting parameters 504 that the user can modify, such as the recording sound device (e.g., a built-in or external microphone), an input volume, an output sound device and/or other sound setting preferences.

In one or more embodiments, the acoustic improvement system provides an actionable suggestion to a user to modify the sound settings of the recoding input device (e.g., microphone). Often, a user can change one or more of these sound settings within a software application. In these embodiments, the acoustic improvement system can link or automatically navigate the user to the sounds settings from an actionable suggestion. For example, the acoustic improvement system detects the user selecting a link within the actionable suggestion and automatically navigates the user to a sound settings user interface.

In some embodiments, the acoustic improvement system provides the sound settings user interface 502 within or adjacent to the interactive interface 202. For example, the acoustic improvement system can provide the sound settings user interface 502 upon launching the acoustic improvement system and/or the interactive interface 202. In one or more embodiments, the acoustic improvement system launches and/or displays the sound settings user interface 502 when a new hardware input is detected (e.g., when the user plugs in an external sound capturing device).

In various embodiments, the sound settings user interface 502 is not part of the acoustic improvement system. For example, the sound settings user interface 502 corresponds to system sound settings of the client device 200. In alternative embodiments, the sound settings user interface 502 is provided as part of the acoustic improvement system. For instance, the acoustic improvement system provides a separate user interface of the sound settings that links to the system sound settings of the client device 200

With respect to the interactive graphical user interface, experimenters have conducted various tests with respect to improving the audio recording quality utilizing the interactive interface. The test results showed that users (including novice users) who utilized the interactive interface with the actionable suggestions disclosed herein were able to significantly improve the audio quality of their digital audio recordings and/or their recording environment. In particular, users interacting with the interactive interface and the actionable suggestions achieved digital audio recordings with an overall acoustic quality score around 20 points (out of 100 points) higher than a set of control users that attempted to improve the audio quality of their digital audio recordings based on viewing acoustic quality metrics alone.

Figure 6A:
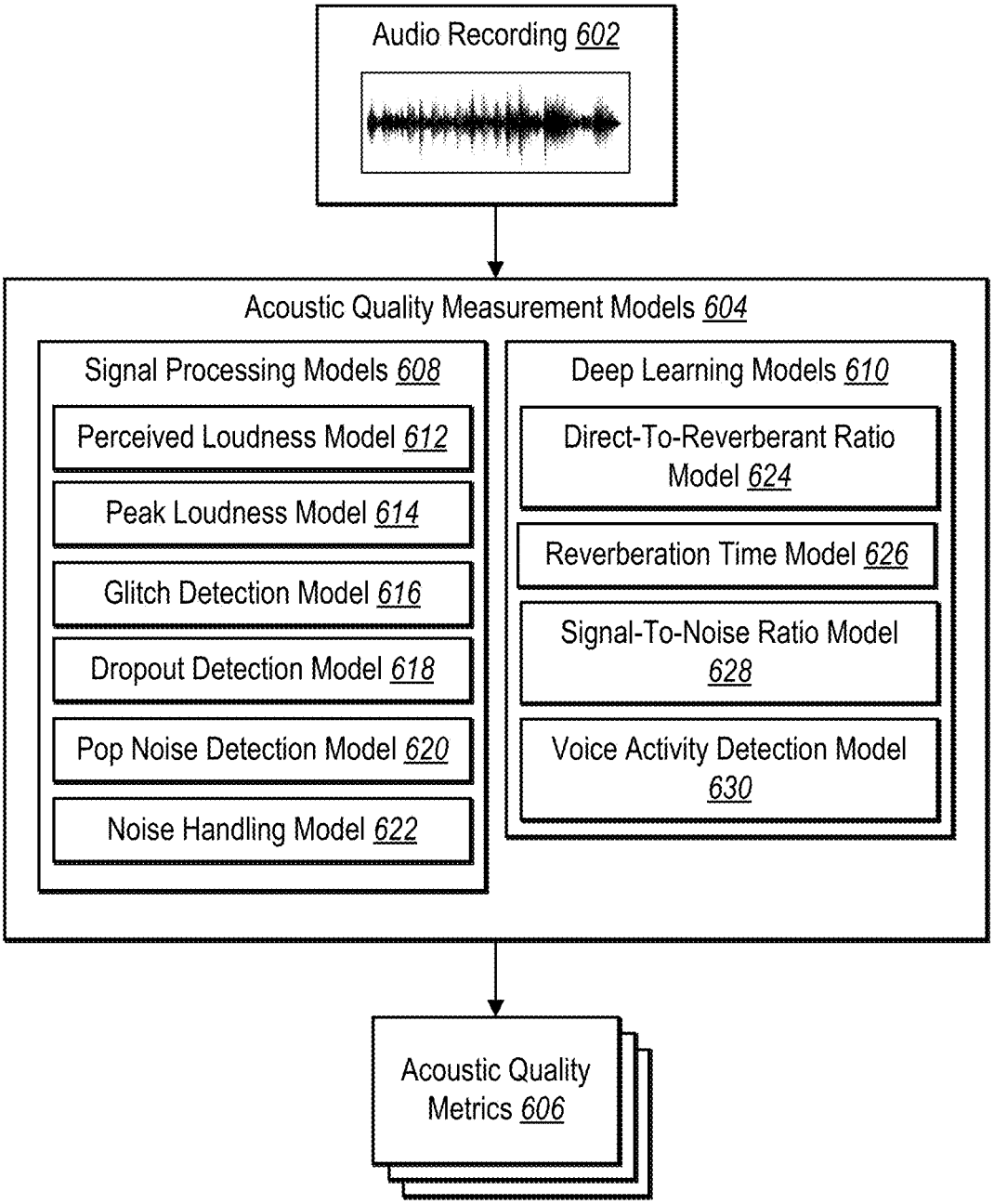
FIGS. 6A-6B illustrate generating acoustic quality metrics for a digital audio recording utilizing acoustic quality measurement models in accordance with one or more embodiments.
Figure 6B:
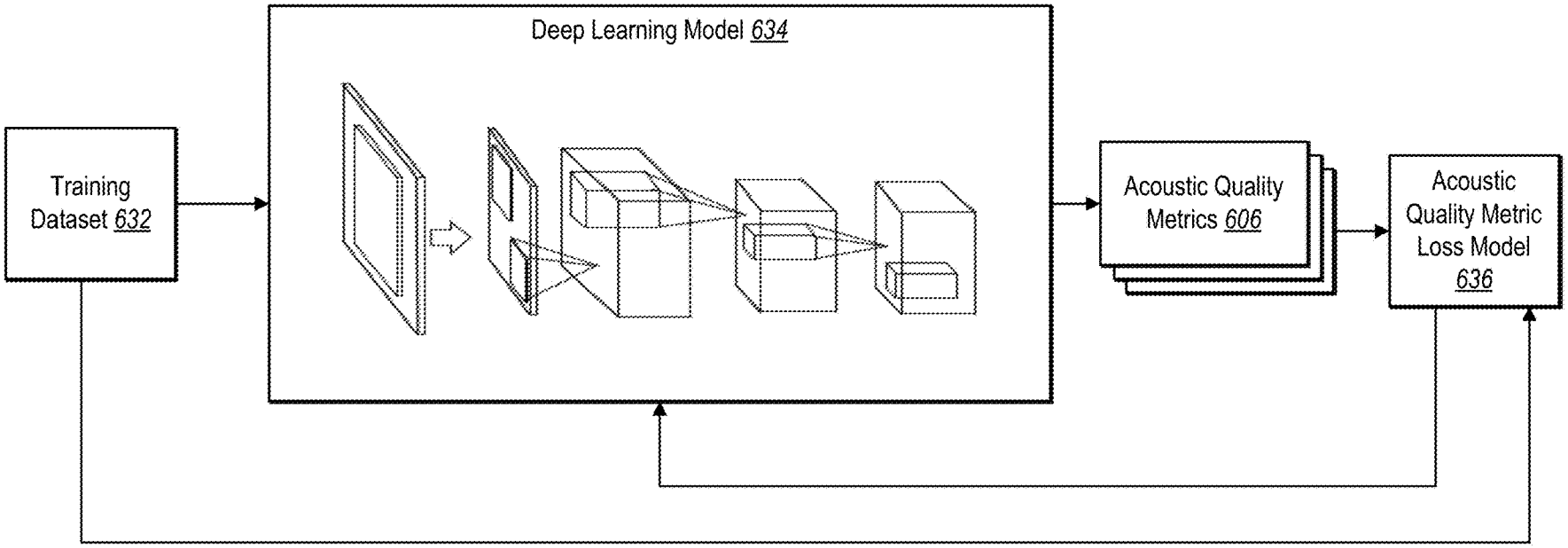

Turning now to FIGS. 6A-6B, additional detail regarding the acoustic improvement system generating acoustic quality metrics from an audio recording is provided. For example, FIG. 6A illustrates generating acoustic quality metrics for an audio recording utilizing acoustic quality measurement models in accordance with one or more embodiments. FIG. 6B illustrates training a neural network for an acoustic quality measurement model.

As shown in FIG. 6A, the acoustic improvement system can analyze an audio recording 602 utilizing one or more acoustic quality measurement models 604 to generate one or more acoustic quality metrics 606. As also shown, the acoustic quality measurement models 604 can include signal processing models 608 and deep learning models 610. As illustrated, the signal processing models 608 can include a perceived loudness model 612, a peak loudness model 614, a glitch detection model 616, a dropout detection model 618, a pop noise detection model 620, and a handling noise model 622. Also, the deep learning models 610 can include a direct-to-reverberant ratio (DRR) model 624, a reverberation time model 626 (e.g., T60, which measures the time needed to lower the sound energy 60 decibels (dBs) from the end of a sound source), a signal-to-noise ratio (SNR) model 628, and a voice activity detection (VAD) model 630.

In some embodiments, one or more of the DRR model 624, the reverberation time model 626, the SNR model 628, and the VAD model 630 can be a signal processing model. Likewise, in one or more embodiments, one of more of the perceived loudness model 612, the peak loudness model 614, the glitch detection model 616, and/or the dropout detection model 618, the pop noise detection model 620, or the handling noise model 622 can be a deep learning model. Additionally, in various embodiments, the acoustic improvement system can utilize fewer or additional signal processing models 608 and/or deep learning models 610.

In one or more embodiments, the acoustic improvement system can utilize one or more of the acoustic quality measurement models 604 to determine acoustic quality metrics (e.g., the loudness metric, the microphone distance/placement metric, the room characteristics metric, and the noise level metric). For example, the acoustic improvement system can utilize the perceived loudness model 612, the peak loudness model 614, the glitch detection model 616, and/or the dropout detection model 618 to determine the loudness metric. In various embodiments, the acoustic improvement system can utilize the reverberation time model to determine the room characteristics metric. In example embodiments, the acoustic improvement system utilizes the SNR model to determine the noise level metric.

In some embodiments, the acoustic improvement system can utilize the pop noise detection model (e.g., a plosive estimator model) and/or the DRR model to generate the microphone distance/placement metric. For example, the acoustic improvement system utilizes the DRR model to detect if a user is too far away from the microphone, but not if the user is too close. However, the plosive estimator model (i.e., pop noise detection model) can detect when the user is too close to the microphone. Thus, used together, the acoustic improvement system can determine the optimal distance of a user to the microphone. Indeed, the acoustic improvement system can weight and/or scale the output of the DRR model and the pop noise detection model to determine the microphone distance/placement metric.

In one or more embodiments, the acoustic improvement system utilizes the acoustic quality measurement models 604 to test various audio categories and attributes. As mentioned above, audio categories can include loudness, microphone distance and placement, room characteristics, and noise levels. Additional principles, context, and examples regarding each of these audio categories will now be provided.

As mentioned above, the signal processing models 608 can correspond to various acoustic quality measurement models 604, such as the perceived loudness model 612, the peak loudness model 614, the glitch detection model 616, the dropout detection model 618, the pop noise detection model 620, and the handling noise model 622. With respect to the perceived loudness model 612 and/or the peak loudness model 614, in various embodiments, the acoustic improvement system can estimate the perceived loudness of an audio recording using one or more measurement standards (e.g., ITU-R BS.1770-4). In this manner, the acoustic improvement system can measure subjective loudness and the true-peak signal level of an audio recording. In many embodiments, the subjective loudness algorithm (i.e., the perceived loudness model 612) can consist of four stages: K frequency weighting, mean square calculation, channel weighting and summation, and gating of low-level content. Also, the true-peak signal level algorithm (i.e., the peak loudness model 614) can consist of first over-sampling a recording, then finding the maximum of the absolute value.

Regarding the glitch detection model 616 and the dropout detection model 618, in one or more embodiments, to detect glitches and digital packet dropouts, the acoustic improvement system can segment a given audio recording into short 1 millisecond blocks (or other segment lengths). Then, the acoustic improvement system determines the energy of each block and compares it against a threshold (e.g., −200 dB). If the energy is below the threshold, the acoustic improvement system detects a glitch. In addition, the acoustic improvement system utilizes the number of glitches within an audio recording to adjust the loudness score and provide the actionable suggestions.

As mentioned above, voice pops and handling noise can include sudden, irregular low-frequency energy bursts of varying duration. With respect to the pop noise detection model 620, in various embodiments, the acoustic improvement system can detect voice pops and/or handling noise using a single channel detection method, or variant thereof. For example, the acoustic improvement system can determine the short-time Fourier transform of the voice signal and analyze the energy of low-frequency content between 0 and 50 Hz. If the low-frequency energy is above an average of the signal's standard deviation by a given threshold, the acoustic improvement system detects noise. In some embodiments, to reduce false-positive detections for pop noise detection, the acoustic improvement system discards detections that occur when speech is not active, as described below.

With respect to the handling noise model 622, in one or more embodiments, the acoustic improvement system utilizes a similar detector as described above with respect to detecting voice pops. In some embodiments, the acoustic improvement system can detect handling noise without the separate step of filtering out non-speech regions.

As mentioned above, the deep learning models 610 can include the direct-to-reverberant ratio (DRR) model 624, the reverberation time model (e.g., T60), the signal-to-noise ratio (SNR) model, and the voice activity detection (VAD) model. In various embodiments, the acoustic improvement system trains a separate neural network for each model. However, to capitalize on efficiency, the acoustic improvement system can utilize the same architecture and training methods for each of the deep learning models 610.

More particularly, for each of the deep learning models 610 mentioned above, the acoustic improvement system can utilize a common synthetically generated voice dataset, as well as a (mostly) shared front-end feature extraction method, such as a Mel-frequency warped spectrogram representation. In addition, the acoustic improvement system can utilize and train a shared convolutional neural network (CNN) having a slightly modified architecture. In this manner, the acoustic improvement system can simplify the training and application process. In addition, the acoustic improvement system can significantly reduce the computational complexity needed to determine various acoustic quality metrics 606.

To illustrate, FIG. 6B shows training a deep learning model 634, where the deep learning model 634 can represent each of the deep learning models 610 mentioned above. As shown, FIG. 6B includes the training dataset 632 (e.g., a synthetically generated voice dataset), the deep learning model 634 being trained (e.g., as a convolutional neural network), the acoustic quality metrics 606 output from the deep learning model 634, and an acoustic quality metric loss model 636. Once trained, the acoustic improvement system can remove the acoustic quality metric loss model 636 and utilize the deep learning model 634 to generate one or more corresponding acoustic quality metrics 606.

In one or more embodiments, the acoustic improvement system generates or otherwise obtains the training dataset 632. For example, the acoustic improvement system can facilitate the generation of a large dataset of noisy reverberated speech by using a standard linear acoustic model, as shown in Equation 1 below.

$$y(t)=x(t)*h(t)+n(t) \tag{1}$$

In Equation 1, y(t) can represent a microphone mixture recording with respect to time t, x(t) can represent anechoic (e.g., speech without echoes) clean speech, h(t) can represent a room impulse response (IR), n(t) can represent background noise, and "*" can represent the convolution operator. In some instances, the acoustic improvement system accesses the anechoic speech content, and utilizes various speakers (e.g., 20 speakers) reading from stories (e.g., from the public domain). In addition, the acoustic improvement system can generate the background noise, and/or use pre-recorded noise from a sound repository. Further, the acoustic improvement system can utilize a number (e.g., 7,000) of synthetically generated acoustic impulse responses to train one or more deep learning models. In some embodiments, the impulse responses can be generated to have uniformly random statistics (e.g., yielding a DRR between −6-18 dB and T60 between 0.1-1.5 seconds).

Moreover, the training dataset 632 can be separated into training, testing, and validation partitions. Further, in some embodiments, the individual speech and noise recordings are sliced into non-overlapping eight-second clips. As an example, 1,008 training noise files, 258 validation noise files, and 317 raw test noise files are generated; 4,480 training impulse response files, 1,120 validation impulse response files, and 1,400 raw test impulse response files are generated; and 1,131 training speech files, 389 validation speech files, and 370 raw test speech files are generated.

In additional embodiments, for a given partition, a two-second segment mixture recording with at least 0.6 seconds of the terminated worker-second segment including speech activity (e.g., 30% of the segment) as well as an eight-second utterance mixture recording with the constraint that there is at least 3-5 seconds of speech activity can be simultaneously generated. In these and other cases, the acoustic improvement system can identify the ground truth label values for later evaluation (e.g., utilizing the acoustic quality metric loss model 636). While a 30% speech activity rate is generally desired as it roughly matches the activity pattern of conversational speech, other speech activity rates can be utilized.

In addition, in various embodiments, the training dataset 632 can be generated by first looping over each speech sample; randomly sampling a noise and an impulse response file; and mixing the speech, the impulse response files, and the noise using Equation 1. Further, as part of mixing, a scaling can be applied to x(t)*h(t) to impose a uniformly random SNR between 0-45 dB as well as applying a uniformly random scaling to y(t) to simulate different microphone volume levels between −45 and −25 dBs of active speech levels.

In additional embodiments, the data generation process can be repeated numerous times. For example, upon repeating the above process 50 times, 56,500 training data samples, 19,399 validation data samples, and 18,449 test data samples for both the segment set and utterance set of the training dataset 632 can be generated, which can result in over 31 hours of training data for the segment set and over 125 hours of training data for the for the utterance set.

As mentioned above, the acoustic improvement system can utilize the training dataset 632 to train each of the deep learning model 634. For example, in various embodiments, the acoustic improvement system utilizes the segment set of the training dataset 632 to train the reverberation time model (e.g., T60), the direct-to-reverberant ratio (DRR) model, and the signal-to-noise ratio (SNR) model. The acoustic improvement system can utilize the segment set to train these deep learning models because these estimators have little-to-no meaning on noise-only regions, the context window of these estimators can be two-seconds (or another length), and real recordings commonly have noise-only regions that are two-seconds or longer. In some embodiments, the acoustic improvement system utilizes the utterance set to train the voice activity detection (VAD) model and/or evaluate system-level performance.

In one or more embodiments, the acoustic improvement system performs pre-processing. For example, in various embodiments, the acoustic improvement utilizes a Mel-frequency warped spectrogram representation (or simply Mel-spectrogram) for front-end feature extraction of the deep learning models 634. For instance, the acoustic improvement system can utilize a fast Fourier transform (FFT) of 256 samples (e.g., a Hann window), a hop size of 128 samples (e.g., 8 ms), with 32 bands, and, area normalization. Further, the acoustic improvement system can compute the power in dB. In additional embodiments, to apply data normalization, the acoustic improvement system can apply a single 32×1-dimensional mean and standard deviation normalization for each time slice. In this manner, the acoustic improvement system can use data normalization as well as circularly buffer the Mel-spectrogram front-end extraction, which further reduces computational costs.

As mentioned above, the acoustic improvement system can separately train different deep learning models. For example, the following description details training a voice activity detection (VAD) model. As a note, many VAD algorithms utilize traditional signal processing methods, however, the deep learning VAD model described herein has been found to outperform these conventional systems.

To illustrate, the acoustic improvement system can generate, train, and utilize a deep convolutional neural network (e.g., deep learning model 634) to determine one or more acoustic quality metrics 606. In various embodiments, the acoustic improvement system can modify the architecture of a convolutional neural network to better fit the goals of the deep learning model disclosed herein (e.g., the DDR model 624, the reverberation time model 626 (e.g., T60), the SNR model 628, and the VAD model 630). For example, the acoustic improvement system utilizes a one-second Mel-Spectrogram input context window (sized at e.g., 32×124) to predict voice activity of the current time frame or a delayed frame within the context window.

The acoustic improvement system then feeds this input to four 2D convolutional layers of the deep learning model 634, each followed by a rectified linear activation function (e.g., ReLU) layer, max-pooling layer, and batch normalization layer (e.g., neural network layers of the deep learning model 634). After the convolutional layers, the acoustic improvement system can utilize a dropout layer (e.g., 50%) and a fully connected layer. Further, the acoustic improvement system can utilize a sigmoid activation function to predict a scalar value (e.g., voice on or off).

In some embodiments, the acoustic improvement system utilizes a max-pooling size having a size identical to the convolutional layer filter size for each layer, respectively. To illustrate, Table 1 below provides an example specification of the convolutional neural network layers configuration of the deep learning model 634. In various embodiments, the convolutional neural network layer specification of Table 1 corresponds to the DDR model 624, the reverberation time model 626 (e.g., T60), and/or the SNR model 628. When the acoustic improvement system utilizes the deep learning model 634 for VAD estimations, the acoustic improvement system can maintain the same network architecture but remove the convolutional layer (i.e., Cony. Layer 1).

TABLE 1

| | Conv. Layer 1-2 | Conv. Layer 3-5 | Conv. Layer 5 |
|---|---|---|---|
| Number of Filters | 8 | 16 | 32 |
| Size | 1 × 2 | 1 × 2 | 2 × 2 |

With respect to the training the VAD model (e.g., a VAD deep learning model), by following the convolutional neural network layer specification of Table 1, the acoustic improvement system can achieve 8,321 trainable parameters for the VAD model. For example, given the architecture shown in Table 1, the acoustic improvement system can train the VAD model to minimize cross-entropy loss via the acoustic quality metric loss model 636 (e.g., using an ADAM optimizer over 500 iterations). Further, while training, in some embodiments, the acoustic improvement system can randomly sample data points from the utterance train dataset and select the model with the lowest validation error for further evaluation.

As briefly mentioned above, the acoustic improvement system can train the deep learning model 634 utilizing the acoustic quality metric loss model 636. Described at a high level, the acoustic improvement system utilizes the acoustic quality metric loss model 636 to provide feedback based on the accuracy of the acoustic quality metric estimations. For example, the acoustic improvement system utilizes the acoustic quality metric loss model 636 to determine an estimation error amount between the acoustic quality metrics 606 predicted by the deep learning model 634 and ground truth information provided the training dataset 632. Then, utilizing the estimation error amount, the acoustic improvement system iteratively updates the tunable weights parameters of the various layers of the deep learning model 634 until the error amount is minimized, a timer is reached, or the number of iterations reaches a predetermined limit.

Additionally, experimenters tested embodiments of the deep learning model 634 trained as a VAD model. In particular, the inventors tested for VAD metrics with respect to accuracy, recall, precision, and harmonic average of precision and recall (i.e., F1). In general, the tests show that the VAD deep learning model generally outperformed other VAD systems.

Regarding SNR estimation (e.g., an SNR deep learning model), in one or more embodiments, the acoustic improvement system trains a deep learning model 634 as a convolutional neural network to directly estimate the SNR when speech is active in an input sample. For instance, in various embodiments, the acoustic improvement system can modify the architecture and training procedure, as described above with respect to the VAD model. In particular, the acoustic improvement system can utilize the two-second segments described above, remove the sigmoid non-linearity at the end of the deep learning model 634, and train the deep learning model 634 do directly minimize the mean squared error (MSE) of the SNR. Again utilizing the convolutional neural network layer specification shown in Table 1, the acoustic improvement system can determine a total of 8,585 trainable parameters for the SNR deep learning model.

As mentioned above, the acoustic improvement system can train the SNR deep learning model to estimate SNR directly from speech segments rather than noise-only and speech-only segments. Indeed, the acoustic improvement system can train the SNR deep learning model to accurately perform SNR estimations when a digital audio recording being analyzed is a speech-only segment. In this manner, the acoustic improvement system can generate an SNR deep learning model that operates with more flexibility than conventional systems.

Regarding the T60 (i.e., a reverberation time model) and the DDR model, the acoustic improvement system can train deep learning models to utilize shorter or longer audio recordings with long periods of silence at the beginning or end of the audio recording. In some embodiments, training for shorter audio recordings can simplify the complexity of the deep learning model 634, which results in computational savings. For example, in various embodiments, the acoustic improvement system can train the T60 deep learning model and/or the DRR model to utilize the same two-second segment dataset, architecture, and training procedure as described above with respect to the SNR deep learning model.

As mentioned above, in some embodiments, the acoustic improvement system can determine significant (or noteworthy) segments of a digital audio recording in order to reduce computational processing costs by focusing on those significant segments while ignoring the other segments. In one or more embodiments, the acoustic improvement system utilizes the VAD model to determine which segments of a digital audio recording contain speech and which segments contain noise. Then, using the voice or speech segments, the acoustic improvement system can determine additional acoustic quality metrics utilizing other deep learning models, such as the SNR deep learning model, the reverberation time model, and the DRR model.

Figure 7:
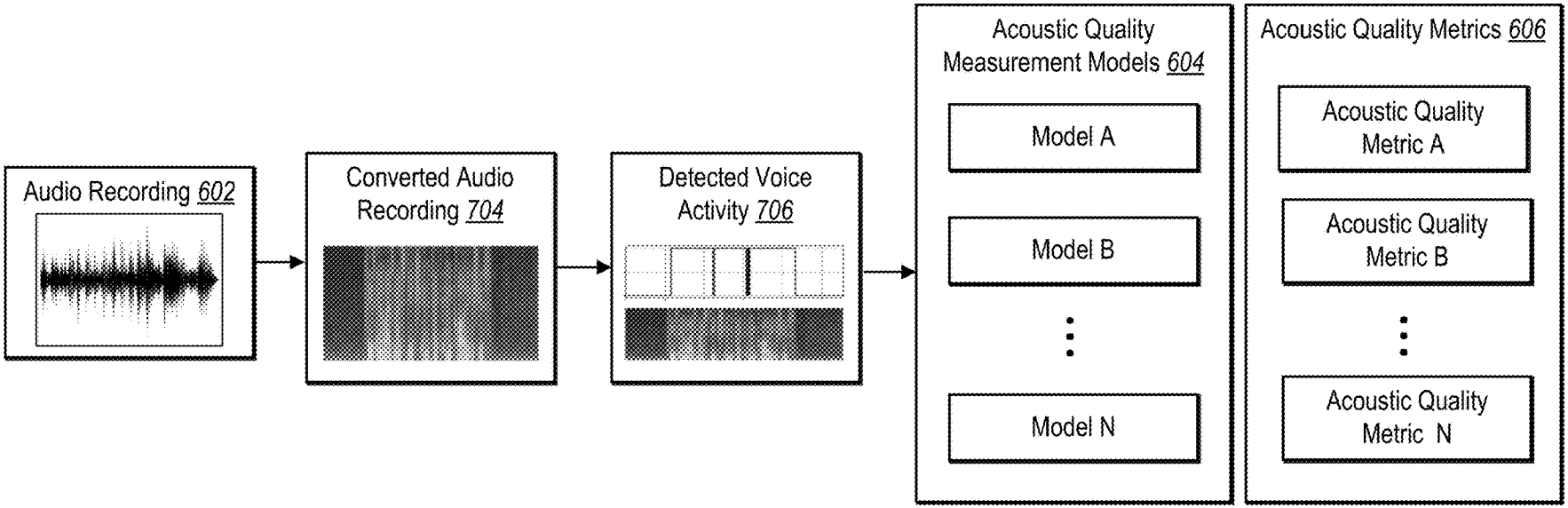
FIG. 7 illustrates generating acoustic quality metrics utilizing selected portions of a digital audio recording in accordance with one or more embodiments.

To illustrate, FIG. 7 shows generating acoustic quality metrics utilizing selected portions of a digital audio recording in accordance with one or more embodiments. In various embodiments, the acoustic improvement system performs the actions corresponding to FIG. 7. As shown, FIG. 7 includes the audio recording 602, acoustic quality measurement models 604, and acoustic quality metrics 606 introduced previously with respect to FIG. 6A.

As shown in FIG. 7, the acoustic improvement system can receive the audio recording 602, as described above. Further, the acoustic improvement system can convert the audio recording 602 into a converted audio recording 704. For instance, in some embodiments, the acoustic improvement system converts the audio recording 602 from a time domain to a time-frequency domain. For example, the acoustic improvement system generates a Mel-Spectrogram of the audio recording 602 within the time-frequency domain, as shown in connection with the converted audio recording 704.

In additional embodiments, the acoustic improvement system can apply the trained VAD model to the audio recording 602 (e.g., the converted audio recording 704). As shown, the acoustic improvement system generates detected voice activity 706 from the converted audio recording 704. In particular, FIG. 7 illustrates a logic signal indicating the segments of the audio recording 602 that include speech (e.g., shown as a high logic signal in the graph above the Mel-Spectrogram in the detected voice activity 706 box) and the segments of the audio recording 602 where no speech is detected (e.g., shown as a low logic signal).

Moreover, upon detecting voice activity segments of the audio recording 602 that include speech (e.g., significant segments), the acoustic improvement system can determine one or more acoustic quality metrics, as provided above. Indeed, the acoustic improvement system can non-intrusively utilize audio estimation algorithms to predict acoustic quality metrics on segments that include voice activity while ignoring immaterial segments without voice activity.

As mentioned above, the acoustic improvement system can generate the acoustic quality metrics 606 (e.g., acoustic quality metric A, acoustic quality metric B, . . . , acoustic quality metric N) from the detected voice activity 706 utilizing the acoustic quality measurement models 604 (e.g., Model A, Model B, . . . , Model N). For example, the acoustic quality measurement models 604 can include deep learning models, signal processing models, or both. For example, in some embodiments, the acoustic quality measurement models 604 include one or more of the deep learning models, such as the reverberation time model (e.g., T60), the DRR model, and/or the SNR model. In additional or alternative embodiments, the acoustic quality measurement models 604 include one or more of the signal processing algorithms, such as the perceived loudness model, the peak loudness model, the glitch detection model, the dropout detection model, the pop noise detection model, and/or the handling noise model.

In various embodiments, the acoustic improvement system utilizes the VAD model to determine when sufficient speech activity is detected (e.g., 30% of a two-second segment contains speech). In some embodiments, the acoustic improvement system averages the frame-level VAD estimates across the time context window (e.g., the two-second context window). When sufficient speech activity is detected, the acoustic improvement system can determine one or more acoustic quality metrics 606 for the segment utilizing the acoustic quality measurement models 604. In additional embodiments, the acoustic improvement system can utilize a long-term recursive average of the estimates over time to compute more stable estimates for the complete utterance data samples and, in some instances, also provide the final average to the user.

In one or more embodiments, the VAD model detects that an audio recording does not include enough speech content for accurate acoustic quality metric estimates. If this occurs while a user is utilizing the interactive graphical user interface, the acoustic improvement system can notify the user, within the interactive graphical user interface, that a new audio recording with more speech is needed. In this manner, the acoustic improvement system can utilize the VAD model as an initial quality metric gatekeeper to detect recording errors before passing on the audio recording to additional acoustic quality measurement models to determine quality measurement models from the noisy and/or silent audio recording (i.e., to avoid wasting computing resources).

Turning now to FIG. 8, as mentioned above, additional disclosure is provided regarding determining actionable suggestions from acoustic quality metrics. In particular, FIG. 8 illustrates determining actionable acoustic improvement suggestions for a digital audio recording utilizing acoustic quality metrics in accordance with one or more embodiments. In various embodiments, the acoustic improvement system can implement the actions described with respect to FIG. 8.

As shown, FIG. 8 includes an acoustic quality metric 802, which can represent one of the acoustic quality metrics previously described. For example, the acoustic improvement system determines the acoustic quality metric 802 utilizing one of the acoustic quality measurement models. Further, the acoustic improvement system can utilize the acoustic quality metric 802 in connection with the actionable acoustic improvement suggestion table 806 (or simply "actionable suggestion table 806").

In one or more embodiments, before providing the acoustic quality metric 802 to the actionable suggestion table 806, the acoustic improvement system can normalize the acoustic quality metric 802. To illustrate, FIG. 8 optionally includes a normalized acoustic quality metric 804. For example, the acoustic improvement system scales or otherwise weights the acoustic quality metric 802 to a common range (e.g., 0-100). In this manner, each of the acoustic quality metrics is normalized to the same metric range, which enables a user to easily compare acoustic quality metrics when presented within the interactive graphical user interface. In alternative embodiments, the acoustic improvement system can normalize the acoustic quality metric 802 after providing it to the actionable suggestion table 806.

As mentioned above, the acoustic improvement system can analyze the acoustic quality metric 802 and/or the normalized acoustic quality metric 804 in light of the actionable suggestion table 806. More specifically, the acoustic improvement system can utilize the actionable suggestion table 806 to determine one or more actionable acoustic improvement suggestions based on the acoustic quality metric 802.

As shown, the actionable suggestion table 806 includes columns for acoustic models, acoustic categories (i.e., acoustic quality categories), metric score range, and actionable suggestions. The column for acoustic models includes a list of various acoustic quality measurement models (e.g., Model A-Model E). For example, acoustic quality measurement models include the perceived loudness model, the peak loudness model, the glitch detection model, the dropout detection model, the pop noise detection model, and/or the handling noise model, the reverberation time model, the DRR model, and/or the SNR model.

In addition, the actionable suggestion table 806 includes the acoustic category column (e.g., Category A-Category D). Examples of acoustic categories can include loudness, microphone distance/placement, room characteristics, and noise level among other acoustic categories. In general, the acoustic categories correspond to the acoustic quality metrics displayed in an interactive graphical user interface, as described above.

In one or embodiments, each model corresponds to an acoustic category. For instance, the SNR model can correspond to the acoustic category of noise. In some embodiments, multiple models correspond to an acoustic category. For example, the perceived loudness model and the peak loudness model can each correspond to the loudness acoustic category.

As shown, the actionable suggestion table 806 includes the metric score range column (e.g., Model A, Range A-Model E, Range C). If the acoustic quality metric 802 is normalized (e.g., 0-100), each of the ranges can match the normalized range (e.g., 0-100) or higher if the corresponding acoustic quality metric exceeds 100 (as described above). Otherwise, if the acoustic quality metric 802 is not normalized, the metric score range corresponding to a given acoustic quality measurement model can correspond to the range of the acoustic quality measurement model.

Further, the actionable suggestion table 806 includes the actionable suggestions column (e.g., Category A, Suggestion A-Category D, Suggestion C). In various embodiments, the actionable suggestions can include one or more text-based (or audible-based or graphics-based) actionable acoustic improvement suggestions, which the acoustic improvement system can dynamically present in the interactive graphical user interface, as described above. As shown, the actionable suggestions can link to an acoustic category. For example, each acoustic category can correspond to a set or group of actionable suggestions that provide actions for improving the audio quality of a digital audio recording with respect to that category. To illustrate, for a category of "microphone placement: the actionable suggestions column could include the actionable suggestions of "move closer to the microphone," "move farther away from the microphone," or "no adjustment needed." The actionable suggestions could also include further detailed actions (e.g., move 6 inches closer).

As mentioned previously, the acoustic improvement system can determine a specific actionable suggestion based on the numeric value of an acoustic quality metric. To illustrate, upon identifying and/or determining the acoustic quality metric 802, the acoustic improvement system can identify the acoustic quality measurement model that corresponds to the numeric value of the acoustic quality metric 802 utilizing the actionable suggestion table 806. Based on the identified acoustic quality measurement model, the acoustic improvement system can identify the metric score range that includes the quality metric 802 for the corresponding acoustic quality measurement model.

Further, upon identifying the applicable metric score range, the acoustic improvement system can select the corresponding actionable acoustic improvement suggestion 808, which is adjacent to the metric score range within the actionable suggestion table 806. Indeed, the acoustic improvement system can map the acoustic quality measurement model to an acoustic category and the numerical score of the acoustic quality metric 802 as an index within the actionable suggestion table 806 to look up one of the pre-generated actionable acoustic improvement suggestion 808.

In some embodiments, the acoustic improvement system may identify two acoustic quality metrics that correspond to the same category. For example, the perceived loudness model (e.g., Model B) and the peak loudness model (e.g., Model C) can each correspond to the loudness acoustic category (e.g., Category B). In these embodiments, the acoustic improvement system can apply a set of guidelines or rules to determine which of the actionable suggestions to provide to the user for that category. Indeed, while the actionable suggestion table 806 appears as a look-up table, the actionable suggestion table 806 can include additional multiple conditions, algorithms, and/or rules (e.g., that manage which actionable suggestion to select for an acoustic category when two acoustic quality metrics map to two different actionable suggestions for the acoustic category, or whether to select and display both actionable suggestions to a user within the interactive graphical user interface).

In alternative embodiments, the acoustic improvement system can combine the scores of model results for each of the acoustic quality measurement models corresponding to an acoustic category before mapping the combined score (e.g., acoustic quality metric 802) to the actionable suggestions. In this manner, the actionable suggestion table 806 can serve as a quick-reference look-up table that maps an acoustic quality metric for one category to an actionable suggestion corresponding to that acoustic category.

FIGS. 6A-8 describes various embodiments of determining actionable acoustic improvement suggestions for a digital audio recording based on acoustic quality measurement models, acoustic quality metrics, audio categories, and/or sets of actionable acoustic improvement suggestions. Accordingly, the actions and algorithms described in connection with FIGS. 6A-8 provide an example structure, architecture, and actions for performing a step for generating a plurality of acoustic improvement suggestions from the audio input and a plurality of acoustic quality measurement models.

Figure 9:
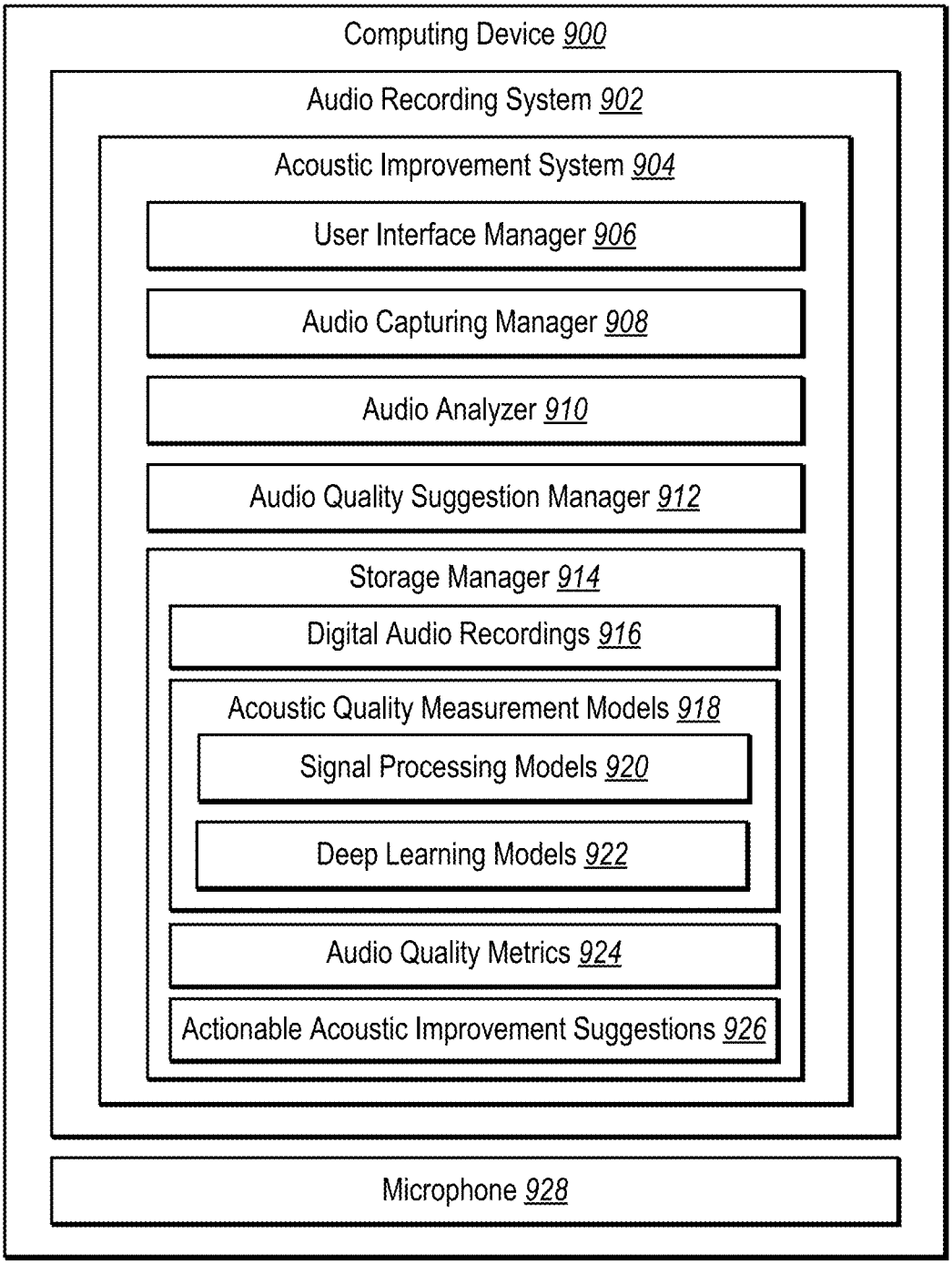
FIG. 9 illustrates a schematic diagram of an acoustic improvement system in accordance with one or more embodiments.

Referring now to FIG. 9, additional detail is provided regarding the capabilities and components of an acoustic improvement system 904 in accordance with one or more embodiments. In particular, FIG. 9 shows a schematic diagram of an example architecture of the acoustic improvement system 904 implemented within an audio recording system 902 and hosted on a computing device 900. The acoustic improvement system 904 can represent one or more of the acoustic improvement systems previously described.

In addition, the computing device 900 may represent various types of computing devices. For example, in some embodiments, the computing device 900 is a mobile computing device, such as a laptop, a tablet, a mobile telephone, a smartphone, etc. In one or more embodiments, the computing device 900 is a non-mobile computing device, such as a server, a cluster of servers, a desktop, or another type of non-mobile computing device. Additional details with regard to the computing device 900 are discussed below with respect to FIG. 12.

As shown, the computing device 900 includes the audio recording system 902 and a microphone 928. In one or more embodiments, the microphone 928 includes one or more microphones integrated into the computing device 900 (e.g., an internal microphone). In alternative embodiments, the microphone 928 is an external microphone that is connected to the computing device 900 via a wired or wireless connection.

The audio recording system 902, in various embodiments, can capture, record, play, edit, modify, delete, store, share, receive, transmit, and/or import digital audio recordings (as well as live/real-time non-recorded audio). For example, the audio recording system 902 is in communication with audio capturing hardware to capture speech from a user. In general, the audio recording system 902 can facilitate capturing digital audio recordings on the computing device 900.

As illustrated in FIG. 9, the acoustic improvement system 904 includes various components for performing the processes and features described herein. For example, the acoustic improvement system 904 includes a user interface manager 906, an audio capturing manager 908, an audio analyzer 910, an audio quality suggestion manager 912, and a storage manager 914. As shown, the storage manager 914 includes digital audio recordings 916, acoustic quality measurement models 918 storing signal processing models 920 and deep learning models 922, acoustic quality metrics 924, and actionable acoustic improvement suggestions 926.

As mentioned above, the acoustic improvement system 904 includes the user interface manager 906. In various embodiments, the user interface manager 906 provides, manages, and/or controls an interactive graphical user interface (or simply "interactive interface") for use with the acoustic improvement system 904, as described above. The interactive interface may be composed of a plurality of graphical components, objects, and/or elements that allow a user to interact with the acoustic improvement system 904. In addition, the user interface manager 906 can provide a variety of user interfaces specific to any variety of functions, programs, applications, plug-ins, devices, operating systems, and/or components of a client device. Further, the user interface manager 906 can detect user interactions by a user with respect to the interactive interface and/or other graphical user interfaces.

As shown, the acoustic improvement system 904 includes the audio capturing manager 908. In various embodiments, the audio capturing manager 908 can capture, record, store, playback, remove, and/or delete one or more digital audio recordings 916. In some embodiments, the audio capturing manager 908 communicates with the audio recording system 902 to capture a digital audio recording. For instance, the acoustic improvement system 904 receives digital audio recordings 916 captured from the microphone 928 associated with the computing device 900. In some embodiments, in response to the user interface manager 906 detecting a user selecting a start-recording element within an interactive graphical user interface, the audio capturing manager 908 captures a digital audio recording. In some embodiments, the audio capturing manager 908 can display a waveform to the user as the digital audio recording is being captured or played back.

As shown, the acoustic improvement system 904 includes the audio analyzer 910. In one or more embodiments, the audio analyzer 910 determines, identifies, measures, quantifies, analyzes, calculates, and/or maps the acoustic quality of a digital audio recording utilizing one or more acoustic quality measurement models 918. For example, the audio analyzer 910 can utilize signal processing models 920 and/or deep learning models 922, as detailed above, to determine one or more acoustic quality metrics 924 for the digital audio recording.

As shown, the acoustic improvement system 904 includes the audio quality suggestion manager 912. In various embodiments, the audio quality suggestion manager 912 determines, identifies, calculates, looks up, reverse indexes, locates, and/or ascertains actionable acoustic improvement suggestions 926 with respect to a digital audio recording, as described above. For example, the audio quality suggestion manager 912 can utilize a set of actionable acoustic improvement suggestions to determine an actionable suggestion to provide to a user via the interactive graphical user interface to improve audio recording quality, as provided above. Further, as explained earlier, actionable acoustic improvement suggestions can correspond to an acoustic category and/or a numerical value of an acoustic quality metric corresponding to the acoustic category.

As shown, the acoustic improvement system 904 includes the storage manager 914. As mentioned, the storage manager 914 includes digital audio recordings 916, acoustic quality measurement models 918 including signal processing models 920 and deep learning models 922, acoustic quality metrics 924, and actionable acoustic improvement suggestions 926, each of which is described above.

Each of the components 906-926 of the acoustic improvement system 904 can include software, hardware, or both. For example, the components 906-926 can include one or more instructions stored on a computer-readable storage medium and executable by processors of one or more computing devices, such as a client device (e.g., a mobile client device) or server device. When executed by the one or more processors, the computer-executable instructions of the acoustic improvement system 904 can cause a computing device to perform the feature learning methods described herein. Alternatively, the components 906-926 can include hardware, such as a special-purpose processing device to perform a certain function or group of functions. In addition, the components 906-926 of the acoustic improvement system 904 can include a combination of computer-executable instructions and hardware.

Furthermore, the components 906-926 of the acoustic improvement system 904 may be implemented as one or more operating systems, as one or more stand-alone applications, as one or more modules of an application, as one or more plug-ins, as one or more library functions or functions that may be called by other applications, and/or as a cloud-computing model. Thus, the components 906-926 may be implemented as a stand-alone application, such as a desktop or mobile application. Additionally, the components 906-926 may be implemented as one or more web-based applications hosted on a remote server. The components 906-926 may also be implemented in a suite of mobile device applications or "apps." To illustrate, the components 906-926 may be implemented in an application, including but not limited to ADOBE CREATIVE CLOUD or other digital content applications software packages. The foregoing are either registered trademarks or trademarks of Adobe Inc. in the United States and/or other countries.

Figure 10:
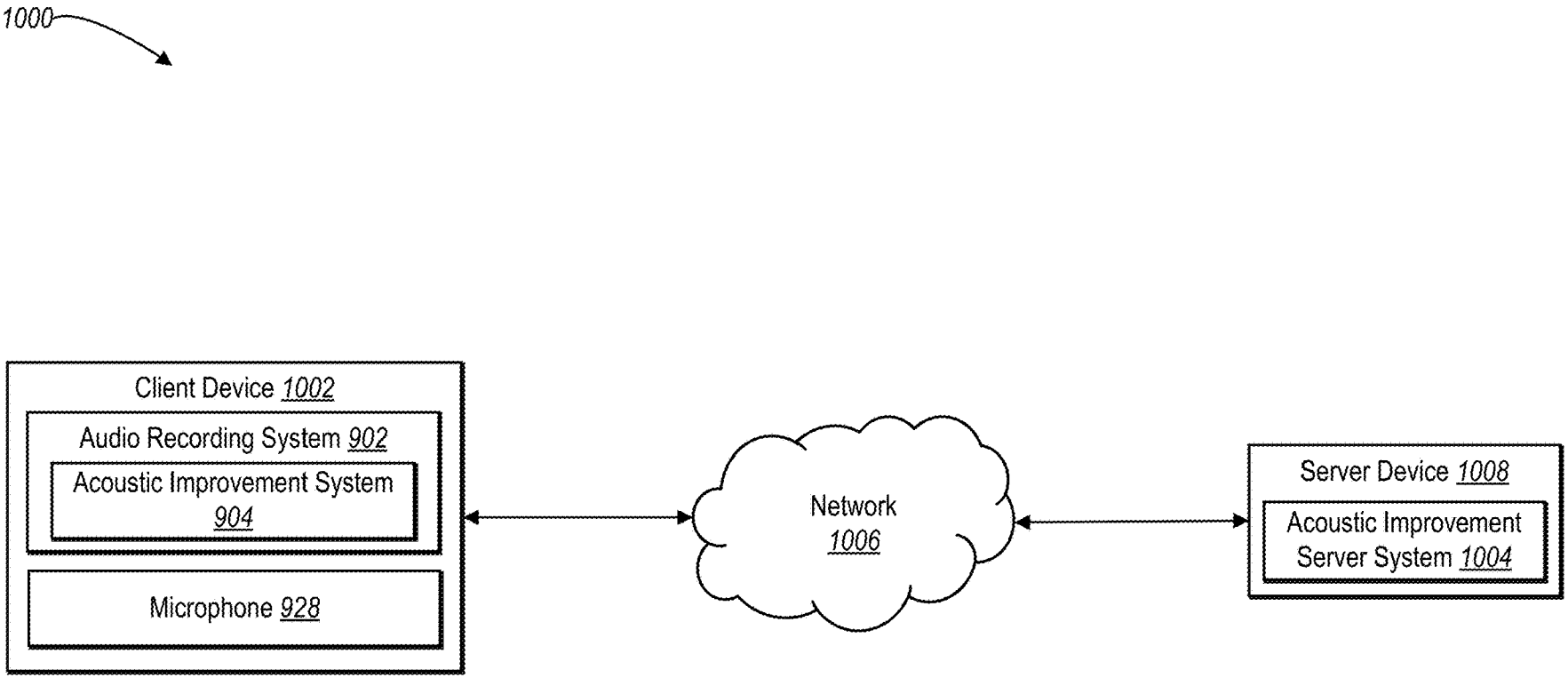
FIG. 10 illustrates a schematic diagram of an environment in which an acoustic improvement system can operate in accordance with one or more embodiments.

FIG. 10 illustrates a schematic diagram of a system environment 1000 in which the acoustic improvement system 904 can operate in accordance with one or more embodiments. As shown in FIG. 10, the environment 1000 includes a client device 1002 and a server device 1008 connected via a network 1006. Additional detail regarding computing devices (e.g., the client device 1002 and the server device 1008) is provided below in connection with FIG. 12. Further, FIG. 12 also provides detail regarding networks, such as the illustrated network 1006.

Although FIG. 10 illustrates a particular number, type, and arrangement of components within the environment 1000, various additional environment configurations are possible. For example, the server device 1008 can represent a set of connected server devices. As another example, the environment 1000 can include an additional number of client devices. As a further example, the client device 1002 may communicate directly with the server device 1008, bypassing the network 1006 or utilizing a separate and/or additional network.

As shown, the client device 1002 includes the acoustic improvement system 904 implemented within the audio recording system 902, which is described above. In one or more embodiments, the acoustic improvement system 904 operates on a client device without the audio recording system 902. Further, the client device 1002 includes the microphone 928, which is introduced above.

As shown, the environment 1000 includes the server device 1008 implementing an acoustic improvement server system 1004. In one or more embodiments, the acoustic improvement server system 1004 communicates with the acoustic improvement system 904 on the client device 1002 to facilitate the functions, operations, and actions previously described above with respect to the acoustic improvement system 904. For example, the acoustic improvement server system 1004 can provide digital content (e.g., a web page) to a user on the client device 1002 and to determine and provide actionable acoustic improvement suggestions to the user via an interactive graphical user interface.

Moreover, in one or more embodiments, the acoustic improvement server system 1004 on the server device 1008 can include all, or a portion of, the acoustic improvement system 904. For example, the acoustic improvement system described herein is located on the server device 1008 as the acoustic improvement server system 1004, which is accessed by a user on the client device 1002 via an application on the client device 1002. In some embodiments, the client device 1002 can download all or a portion of a software application corresponding to the acoustic improvement system 904 such that at least a portion of the operations performed by the acoustic improvement system 904 occur on the client device 1002.

FIGS. 1-10, the corresponding text, and the examples provide a number of different methods, systems, devices, and non-transitory computer-readable media of the acoustic improvement system. In addition to the foregoing, one or more embodiments can also be described in terms of flowcharts comprising acts for accomplishing a particular result, such as the flowcharts of acts shown in FIG. 11. Additionally, the acts described herein may be repeated or performed in parallel with one another or parallel with different instances of the same or similar acts.

Figure 11:
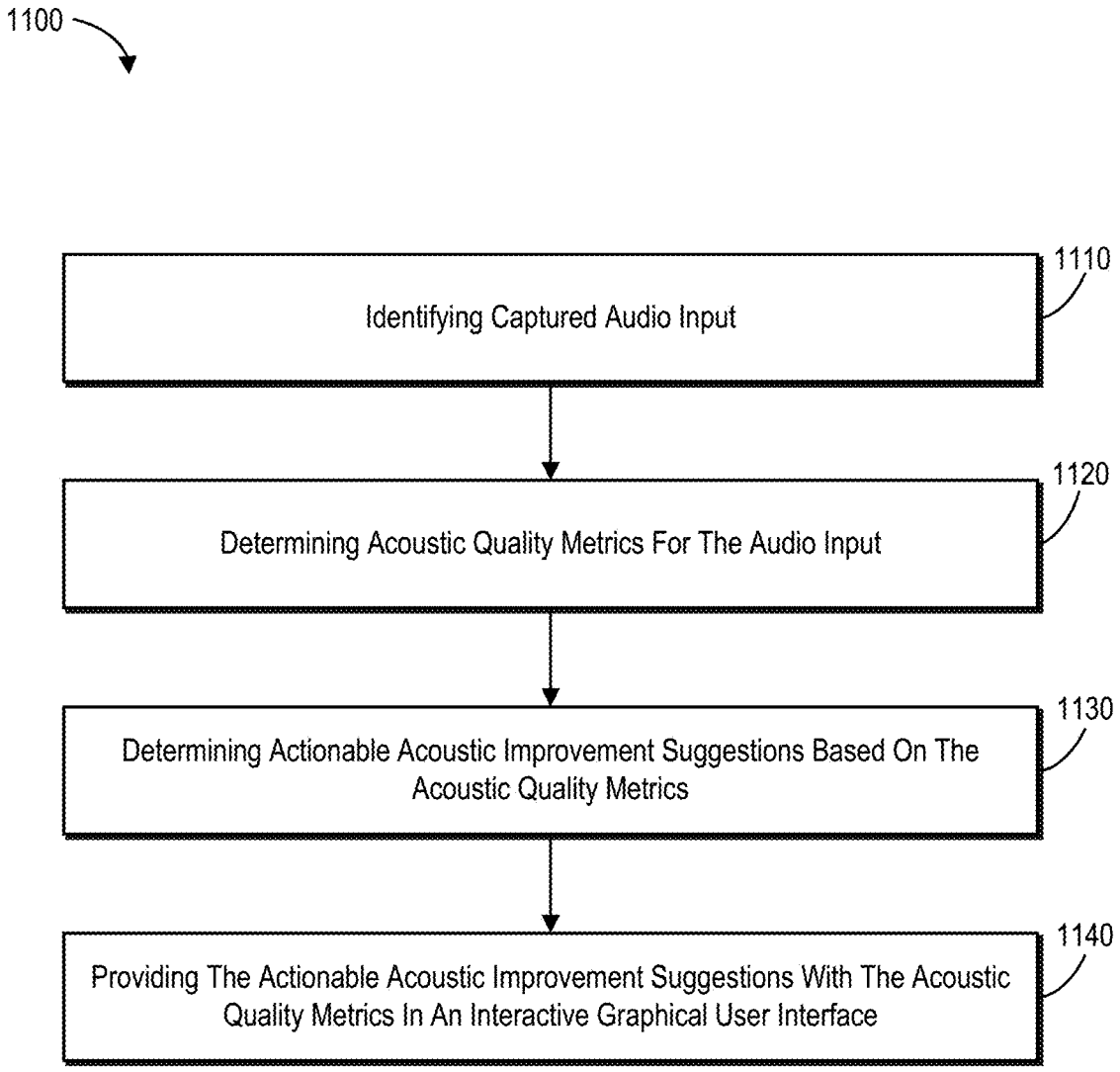
FIG. 11 illustrates a flowchart of a series of acts of determining actionable acoustic improvement suggestions for a digital audio recording in accordance with one or more embodiments.

As mentioned previously, FIG. 11 illustrates a flowchart of a series of acts 1100 of determining actionable acoustic improvement suggestions for a digital audio recording in accordance with one or more embodiments. While FIG. 11 illustrates acts according to one embodiment, alternative embodiments may omit, add to, reorder, and/or modify any of the acts shown in FIG. 11. The acts of FIG. 11 can be performed as part of a method. Alternatively, a non-transitory computer-readable medium can comprise instructions that, when executed by one or more processors, cause a computing device to perform the acts of FIG. 11. In some embodiments, a system can perform the acts of FIG. 11.

In one or more embodiments, the series of acts 1100 is implemented on one or more computing devices, such as the client devices 200, 1002, the server device 1008, or the computing devices 900. In addition, in some embodiments, the series of acts 1100 is implemented in a digital medium environment for capturing audio data. For example, the series of acts 1100 is implemented on a computing device having memory that includes captured audio input, at least three acoustic quality measurement models (selected from a loudness measurement model, a microphone distance measurement model, a room characteristic measurement model, and a noise level measurement model), and a set of actionable acoustic improvement suggestions.

The series of acts 1100 can include an act 1110 of identifying captured audio input. In some embodiments, the act 1110 can involve identifying audio input captured via audio capturing hardware corresponding to a client device. In one or more embodiments, the act 1110 can include capturing audio input (e.g., a digital audio recording) from an external microphone connected to the client device or one or more internal microphones integrated into the client device.

As shown, the series of acts 1100 also includes an act 1120 of determining acoustic quality metrics for the audio input. In particular, the act 1120 can involve determining a plurality of acoustic quality metrics for the audio input by analyzing the audio input utilizing a plurality of acoustic quality measurement models. In one or more embodiments, the plurality of acoustic quality metrics includes either two or more of a microphone distance metric, a loudness metric, a room characteristics metric, and a noise level metric. In various embodiments, the act 1120 can include generating an overall quality score based on combining the plurality of acoustic quality metrics.

In example embodiments, the act 1120 can include determining at least three acoustic quality metrics for the captured audio input by analyzing the captured audio input utilizing the at least three acoustic quality measurement models. For example, the at least three acoustic quality metrics include three or more of a microphone distance metric, a loudness metric, a room characteristics metric, or a noise level metric. In one or more embodiments, the least three acoustic quality measurement models include three or more of a direct-to-reverberant ratio model, a reverberation time model, a voice activity detection model, a signal-to-noise ratio model, a perceived loudness model, a peak loudness model, a glitch detection model, a dropout detection model, a noise handling model, or a pop noise detection model.

In additional embodiments, the plurality of acoustic quality measurement models include a direct-to-reverberant ratio model, a reverberation time model, a voice activity detection model, a signal-to-noise ratio model, a perceived loudness model, a peak loudness model, a glitch detection model, a dropout detection model, a noise handling model, and/or a pop noise detection model. In some embodiments, the act 1120 can include generating the microphone distance metric utilizing the perceived loudness model, the peak loudness model, the glitch detection model, and the dropout detection model. In one or more embodiments, the act 1120 can include generating the loudness metric utilizing the pop noise detection model and the direct-to-reverberant ratio model. In various embodiments, the act 1120 can include generating the room characteristics metric utilizing the reverberation time model.

As shown in FIG. 11, the series of acts 1100 further includes an act 1130 of determining actionable acoustic improvement suggestions based on the acoustic quality metrics. In particular, the act 1130 can include determining, based on the plurality of acoustic quality metrics, a plurality of actionable acoustic improvement suggestions from a set of actionable acoustic improvement suggestions. In one or more embodiments, the plurality of actionable acoustic improvement suggestions comprises text-based suggestions. In alternative embodiments, the plurality of actionable acoustic improvement suggestions is audio suggestions. In some embodiments, the plurality of actionable acoustic improvement suggestions is graphical suggestions. In example embodiments, the act 1130 can include determining, based on the at least three acoustic quality metrics, one or more actionable acoustic improvement suggestions from the set of actionable acoustic improvement suggestions. Further, in additional embodiments, the act 1130 includes generating an overall quality score based on combining the at least three acoustic quality metrics.

As shown, the series of acts 1100 also includes an act 1140 of providing the actionable acoustic improvement suggestions with the acoustic quality metrics in an interactive graphical user interface. In particular, the act 1140 can include providing, for display within an interactive graphical user interface, one or more actionable acoustic improvement suggestions of the plurality of actionable acoustic improvement suggestions together with the plurality of acoustic quality metrics. In one or more embodiments, the act 1140 can include providing a first actionable acoustic improvement suggestion of the one or more actionable acoustic improvement suggestions in response to detecting a first user interaction with a first displayed acoustic quality metric of the plurality of acoustic quality metrics and providing a second actionable acoustic improvement suggestion of the one or more actionable acoustic improvement suggestions in response to detecting a second user interaction with a second displayed acoustic quality metric of the plurality of acoustic quality metrics. In example embodiments, the act 1140 can include providing an actionable acoustic improvement suggestion of the one or more actionable acoustic improvement suggestions together with the at least three acoustic quality metrics for display within an interactive graphical user interface.

In additional embodiments, the act 1140 can include determining a first acoustic quality metric of the plurality of acoustic quality metrics for the audio input by utilizing a first acoustic quality measurement model of the plurality of acoustic quality measurement models, identifying a first group of actionable acoustic improvement suggestions of the set of actionable acoustic improvement suggestions corresponding to the first acoustic quality measurement model, and determining the first actionable acoustic improvement suggestion by mapping the first acoustic quality metric to the first actionable acoustic improvement suggestion within the first group of actionable acoustic improvement suggestions. In example embodiments, the act 1140 can include determining a first acoustic quality metric of the at least three acoustic quality metrics for the audio input by utilizing a first acoustic quality measurement model of the at least three acoustic quality measurement models, identifying a first group of actionable acoustic improvement suggestions of the set of actionable acoustic improvement suggestions corresponding to the first acoustic quality measurement model, and determining a first actionable acoustic improvement suggestion by mapping the first acoustic quality metric to the first actionable acoustic improvement suggestion within the first group of actionable acoustic improvement suggestions.

The series of acts 1100 can include various additional acts. For example, the series of acts 1100 can include the acts of receiving input modifying settings of the audio capturing hardware corresponding to a client device based on providing an actionable acoustic improvement suggestion; identifying new audio input; determining a new plurality of acoustic quality metrics for the new audio input; determining a new plurality of actionable acoustic improvement suggestions from the set of actionable acoustic improvement suggestions based on the new plurality of acoustic quality metrics; and providing, for display within the interactive graphical user interface, one or more new actionable acoustic improvement suggestions of the new plurality of actionable acoustic improvement suggestions together with the new plurality of acoustic quality metrics. In some embodiments, the one or more new actionable acoustic improvement suggestions are different from the one or more actionable acoustic improvement suggestions.

The term "digital environment," as used herein, generally refers to an environment implemented, for example, as a stand-alone application (e.g., a personal computer or mobile application running on a computing device), as an element of an application, as a plug-in for an application, as a library function or functions, as a computing device, and/or as a cloud-computing system. A digital medium environment allows the acoustic improvement system to capture and/or analyze digital audio data and/or digital audio recordings, as described herein.

Embodiments of the present disclosure may comprise or utilize a special-purpose or general-purpose computer including computer hardware, such as, for example, one or more processors and system memory, as discussed in greater detail below. Embodiments within the scope of the present disclosure also include physical and other computer-readable media for carrying or storing computer-executable instructions and/or data structures. In particular, one or more of the processes described herein may be implemented at least in part as instructions embodied in a non-transitory computer-readable medium and executable by one or more computing devices (e.g., any of the media content access devices described herein). In general, a processor (e.g., a microprocessor) receives instructions, from a non-transitory computer-readable medium, (e.g., memory), and executes those instructions, thereby performing one or more processes, including one or more of the processes described herein.

Computer-readable media can be any available media that can be accessed by a general-purpose or special-purpose computer system. Computer-readable media that store computer-executable instructions are non-transitory computer-readable storage media (devices). Computer-readable media that carry computer-executable instructions are transmission media. Thus, by way of example, and not limitation, embodiments of the disclosure can comprise at least two distinctly different kinds of computer-readable media: non-transitory computer-readable storage media (devices) and transmission media.

Non-transitory computer-readable storage media (devices) includes RAM, ROM, EEPROM, CD-ROM, solid-state drives ("SSDs") (e.g., based on RAM), Flash memory, phase-change memory ("PCM"), other types of memory, other optical disk storage, magnetic disk storage or other magnetic storage devices, or any other medium which can be used to store desired program code means in the form of computer-executable instructions or data structures and which can be accessed by a general-purpose or special-purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmissions media can include a network and/or data links which can be used to carry desired program code means in the form of computer-executable instructions or data structures and which can be accessed by a general-purpose or special-purpose computer. Combinations of the above should also be included within the scope of computer-readable media.

Further, upon reaching various computer system components, program code means in the form of computer-executable instructions or data structures can be transferred automatically from transmission media to non-transitory computer-readable storage media (devices) (or vice versa). For example, computer-executable instructions or data structures received over a network or data link can be buffered in RAM within a network interface module (e.g., a "NIC"), and then eventually transferred to computer system RAM and/or to less volatile computer storage media (devices) at a computer system. Thus, it should be understood that non-transitory computer-readable storage media (devices) can be included in computer system components that also (or even primarily) utilize transmission media.

Computer-executable instructions comprise, for example, instructions and data which, when executed by a processor, cause a general-purpose computer, special-purpose computer, or special-purpose processing device to perform a certain function or group of functions. In some embodiments, computer-executable instructions are executed by a general-purpose computer to turn the general-purpose computer into a special-purpose computer implementing elements of the disclosure. The computer-executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the disclosure may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, tablets, pagers, routers, switches, and the like. The disclosure may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

Embodiments of the present disclosure can also be implemented in cloud computing environments. As used herein, the term "cloud computing" refers to a model for enabling on-demand network access to a shared pool of configurable computing resources. For example, cloud computing can be employed in the marketplace to offer ubiquitous and convenient on-demand access to the shared pool of configurable computing resources. The shared pool of configurable computing resources can be rapidly provisioned via virtualization and released with low management effort or service provider interaction, and then scaled accordingly.

A cloud-computing model can be composed of various characteristics such as, for example, on-demand self-service, broad network access, resource pooling, rapid elasticity, measured service, and so forth. A cloud-computing model can also expose various service models, such as, for example, Software as a Service ("SaaS"), Platform as a Service ("PaaS"), and Infrastructure as a Service ("IaaS"). A cloud-computing model can also be deployed using different deployment models such as private cloud, community cloud, public cloud, hybrid cloud, and so forth. In addition, as used herein, the term "cloud-computing environment" refers to an environment in which cloud computing is employed.

Figure 12:
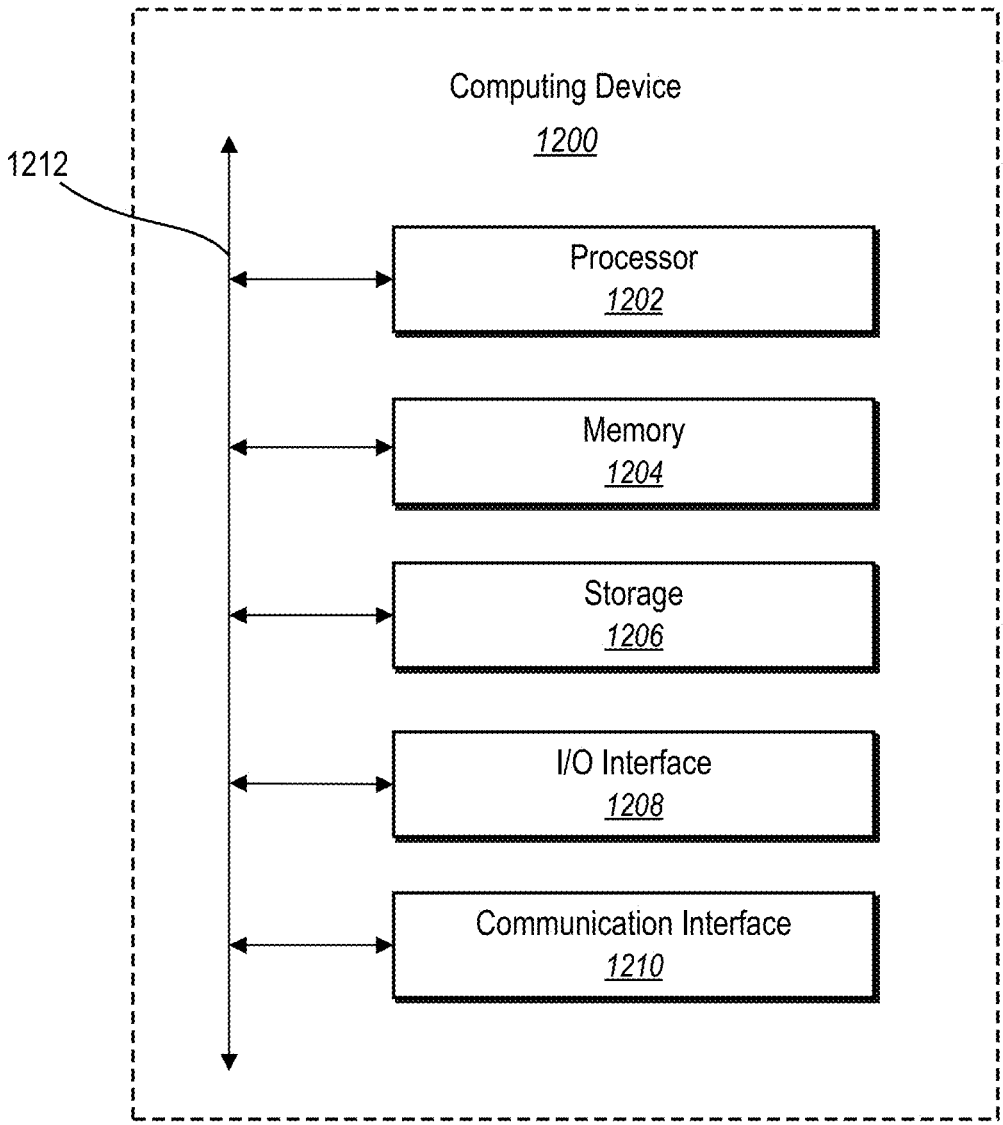
FIG. 12 illustrates a block diagram of an example computing device for implementing one or more embodiments of the present disclosure.

FIG. 12 illustrates a block diagram of an example computing device 1200 that may be configured to perform one or more of the processes described above. One will appreciate that one or more computing devices, such as the client devices 200, 1002, the server device 1008, or the computing devices 900. In one or more embodiments, the computing device 1200 may be a mobile device (e.g., a laptop, a tablet, a smartphone, a mobile telephone, a camera, a tracker, a watch, a wearable device, etc.). In some embodiments, the computing device 1200 may be a non-mobile device (e.g., a desktop computer, a server device, a web server, a file server, a social networking system, a program server, an application store, or a content provider). Further, the computing device 1200 may be a server device that includes cloud-based processing and storage capabilities.

As shown in FIG. 12, the computing device 1200 can include one or more processor(s) 1202, memory 1204, a storage device 1206, input/output ("I/O") interfaces 1208, and a communication interface 1210, which may be communicatively coupled by way of a communication infrastructure (e.g., bus 1212). While the computing device 1200 is shown in FIG. 12, the components illustrated in FIG. 12 are not intended to be limiting. Additional or alternative components may be used in other embodiments. Furthermore, in certain embodiments, the computing device 1200 includes fewer components than those shown in FIG. 12. Components of the computing device 1200 shown in FIG. 12 will now be described in additional detail.

In particular embodiments, the processor(s) 1202 includes hardware for executing instructions, such as those making up a computer program. As an example, and not by way of limitation, to execute instructions, the processor(s) 1202 may retrieve (or fetch) the instructions from an internal register, an internal cache, memory 1204, or a storage device 1206 and decode and execute them.

The computing device 1200 includes memory 1204, which is coupled to the processor(s) 1202. The memory 1204 may be used for storing data, metadata, and programs for execution by the processor(s). The memory 1204 may include one or more of volatile and non-volatile memories, such as Random-Access Memory ("RAM"), Read-Only Memory ("ROM"), a solid-state disk ("SSD"), Flash, Phase Change Memory ("PCM"), or other types of data storage. The memory 1204 may be internal or distributed memory.

The computing device 1200 includes a storage device 1206 includes storage for storing data or instructions. As an example, and not by way of limitation, the storage device 1206 can include a non-transitory storage medium described above. The storage device 1206 may include a hard disk drive (HDD), flash memory, a Universal Serial Bus (USB) drive or a combination these or other storage devices.

As shown, the computing device 1200 includes one or more I/O interfaces 1208, which are provided to allow a user to provide input to (e.g., user strokes), receive output from, and otherwise transfer data to and from the computing device 1200. These I/O interfaces 1208 may include a mouse, keypad or a keyboard, a touch screen, camera, optical scanner, network interface, modem, other known I/O devices or a combination of these I/O interfaces 1208. The touch screen may be activated with a stylus or a finger.

The I/O interfaces 1208 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O interfaces 1208 are configured to provide graphical data to a display for presentation to a user. The graphical data may be representative of one or more graphical user interfaces and/or any other graphical content as may serve a particular implementation.

The computing device 1200 can further include a communication interface 1210. The communication interface 1210 can include hardware, software, or both. The communication interface 1210 provides one or more interfaces for communication (such as, for example, packet-based communication) between the computing device and one or more other computing devices or one or more networks. As an example, and not by way of limitation, communication interface 1210 may include a network interface controller (NIC) or network adapter for communicating with an Ethernet or other wire-based network or a wireless NIC (WNIC) or wireless adapter for communicating with a wireless network, such as a WI-FI. The computing device 1200 can further include a bus 1212. The bus 1212 can include hardware, software, or both that connects components of computing device 1200 to each other.

In the foregoing specification, the invention has been described with reference to specific example embodiments thereof. Various embodiments and aspects of the invention(s) are described with reference to details discussed herein, and the accompanying drawings illustrate the various embodiments. The description above and drawings are illustrative of the invention and are not to be construed as limiting the invention. Numerous specific details are described to provide a thorough understanding of various embodiments of the present invention.

The present invention may be embodied in other specific forms without departing from its spirit or essential characteristics. The described embodiments are to be considered in all respects only as illustrative and not restrictive. For example, the methods described herein may be performed with less or more steps/acts or the steps/acts may be performed in differing orders. Additionally, the steps/acts described herein may be repeated or performed in parallel to one another or in parallel to different instances of the same or similar steps/acts. The scope of the invention is, therefore, indicated by the appended claims rather than by the foregoing description. All changes that come within the meaning and range of equivalency of the claims are to be embraced within their scope.

What is claimed is:

1. A non-transitory computer-readable medium storing instructions that, when executed by at least one processor, cause a computing device to:

provide, for display via an interactive graphical user interface, a speech phrase for generating a speech audio input;

in response to providing the speech phrase, identify the speech audio input captured via audio capturing hardware corresponding to a client device;

determine at least three acoustic quality metrics for the speech audio input by analyzing the speech audio input utilizing a plurality of acoustic quality measurement models, wherein the at least three acoustic quality metrics comprise three or more of a microphone distance metric, a loudness metric, a room characteristics metric, or a noise level metric, and wherein the plurality of acoustic quality measurement models comprises four or more of a direct-to-reverberant ratio model, a reverberation time model, a voice activity detection model, a signal-to-noise ratio model, a perceived loudness model, a peak loudness model, a glitch detection model, a dropout detection model, a handling noise model, or a pop noise detection model;

determine, based on the at least three acoustic quality metrics, a plurality of actionable acoustic improvement suggestions from a set of actionable acoustic improvement suggestions;

provide the at least three acoustic quality metrics for display via the interactive graphical user interface;

in response to a first user interaction with a first acoustic quality metric of the at least three acoustic quality metrics, provide, for display within the interactive graphical user interface, a first actionable acoustic improvement suggestion of the plurality of actionable acoustic improvement suggestions corresponding to the first acoustic quality metric; and in response to a second user interaction with a second acoustic quality metric of the at least three acoustic quality metrics, provide, for display within the interactive graphical user interface, a second actionable acoustic improvement suggestion of the plurality of actionable acoustic improvement suggestions corresponding to the second acoustic quality metric.

2. The non-transitory computer-readable medium of claim 1, further comprising instructions that, when executed by the at least one processor, cause the computing device to determine the microphone distance metric based on combining outputs of multiple acoustic quality measurement models.

3. The non-transitory computer-readable medium of claim 1, further comprising instructions that, when executed by the at least one processor, cause the computing device to:

generate an overall quality score based on combining the at least three acoustic quality metrics; and provide, for display within the interactive graphical user interface, the overall quality score concurrently displayed with the at least three acoustic quality metrics.

4. The non-transitory computer-readable medium of claim 1, further comprising additional instructions that, when executed by the at least one processor, cause the computing device to:

generate the loudness metric utilizing the perceived loudness model, the peak loudness model, the glitch detection model, and the dropout detection model;

generate the microphone distance metric utilizing the pop noise detection model and the direct-to-reverberant ratio model;

generate a noise characteristics metric utilizing the signal-to-noise ratio model and handling noise model; and generate the room characteristics metric utilizing the reverberation time model.

5. The non-transitory computer-readable medium of claim 1, further comprising additional instructions that, when executed by the at least one processor, cause the computing device to:

generate an initial overall quality score based on combining the at least three acoustic quality metrics; and provide the initial overall quality score for display within the interactive graphical user interface.

6. The non-transitory computer-readable medium of claim 5, further comprising additional instructions that, when executed by the at least one processor, cause the computing device to:

provide, for display via the interactive graphical user interface, a prompt to record an additional speech audio input;

in response to providing the prompt to record, identify the additional speech audio input captured via the audio capturing hardware of the client device; and generate an updated overall quality score for display via the interactive graphical user interface concurrently with the initial overall quality score.

7. The non-transitory computer-readable medium of claim 1, further comprising instructions that, when executed by the at least one processor, cause the computing device to provide a third actionable acoustic improvement suggestion of the plurality of actionable acoustic improvement suggestions in response to detecting a third user interaction with a third displayed acoustic quality metric of the at least three acoustic quality metrics.

8. The non-transitory computer-readable medium of claim 7, further comprising additional instructions, when executed by the at least one processor, cause the computing device to:

determine the first acoustic quality metric by utilizing a first acoustic quality measurement model of the plurality of acoustic quality measurement models;

identify a first group of actionable acoustic improvement suggestions of the set of actionable acoustic improvement suggestions corresponding to the first acoustic quality measurement model; and determine the first actionable acoustic improvement suggestion by mapping the first acoustic quality metric to the first actionable acoustic improvement suggestion within the first group of actionable acoustic improvement suggestions.

9. The non-transitory computer-readable medium of claim 1, further comprising additional instructions that, when executed by the at least one processor, cause the computing device to:

provide, for display via the interactive graphical user interface, a prompt to record an additional speech audio input;

in response to providing the prompt to record, identify the additional speech audio input captured via the audio capturing hardware of the client device;

determine at least three updated acoustic quality metrics for the additional speech audio input;

determine, based on the at least three updated acoustic quality metrics, a one or more new actionable acoustic improvement suggestions from the set of actionable acoustic improvement suggestions; and provide, for display within the interactive graphical user interface, the one or more new actionable acoustic improvement suggestions together with the at least three updated acoustic quality metrics.

10. The non-transitory computer-readable medium of claim 1, further comprising additional instructions that, when executed by the at least one processor, cause the computing device to receive input modifying settings of the audio capturing hardware corresponding to a client device based on providing an actionable acoustic improvement suggestion.

11. A system comprising:

one or more memory devices comprising:

captured audio input;

a plurality of acoustic quality measurement models comprising four or more of a direct-to-reverberant ratio model, a reverberation time model, a voice activity detection model, a signal-to-noise ratio model, a perceived loudness model, a peak loudness model, a glitch detection model, a dropout detection model, a handling noise model, or a pop noise detection model; and a set of actionable acoustic improvement suggestions; and one or more server devices that cause the system to:

determine at least three acoustic quality metrics for the captured audio input by analyzing the captured audio input utilizing the plurality of acoustic quality measurement models, wherein the at least three acoustic quality metrics comprise three or more of a microphone distance metric, a loudness metric, a room characteristics metric, or a noise level metric;

determine, based on the at least three acoustic quality metrics, a plurality of actionable acoustic improvement suggestions from the set of actionable acoustic improvement suggestions;

provide, concurrently for display within an interactive graphical user interface, a first actionable acoustic improvement suggestion of the plurality of actionable acoustic improvement suggestions concurrently displayed with visualizations of the at least three acoustic quality metrics in response to detecting a first user interaction with a first displayed acoustic quality metric of the at least three acoustic quality metrics; and provide a second actionable acoustic improvement suggestion of the plurality of actionable acoustic improvement suggestions concurrently displayed with the visualizations of the at least three acoustic quality metrics in response to detecting a second user interaction with a second displayed acoustic quality metric of the at least three acoustic quality metrics.

12. The system of claim 11, wherein the one or more server devices further cause the system to determine the loudness metric based on combining outputs from at least two of the plurality of acoustic quality measurement models.

13. The system of claim 11, wherein the one or more server devices further cause the system to:

generate an initial overall quality score based on combining the at least three acoustic quality metrics; and provide, for display within the interactive graphical user interface, the initial overall quality score concurrently displayed with the at least three acoustic quality metrics.

14. The system of claim 11, wherein the one or more server devices further cause the system to:

generate the loudness metric utilizing the perceived loudness model, the peak loudness model, the glitch detection model, and the dropout detection model;

generate the microphone distance metric utilizing the pop noise detection model and the direct-to-reverberant ratio model;

generate a noise characteristics metric utilizing the signal-to-noise ratio model and the handling noise model; and generate the room characteristics metric utilizing the reverberation time model.

15. The system of claim 13, wherein the one or more server devices further cause the system to:

provide, for display via the interactive graphical user interface, a prompt to record an additional audio input;

in response to providing the prompt to record, identify the additional audio input and determining at least three updated acoustic quality metrics;

generate an updated overall quality score based on combining the at least three updated acoustic quality metrics; and provide, for display via the interactive graphical user interface, the updated overall quality score concurrently with the initial overall quality score.

16. The system of claim 11 wherein the one or more server devices further cause the system to:

determine a first acoustic quality metric of the at least three acoustic quality metrics for the captured audio input by utilizing a first acoustic quality measurement model of the plurality of acoustic quality measurement models;

identify a first group of actionable acoustic improvement suggestions of the set of actionable acoustic improvement suggestions corresponding to the first acoustic quality measurement model; and determine a first actionable acoustic improvement suggestion by mapping the first acoustic quality metric to the first actionable acoustic improvement suggestion within the first group of actionable acoustic improvement suggestions.

17. In a digital medium environment for capturing audio data, a computer-implemented method of improving audio recordings, comprising:

identifying a speech audio input captured via audio capturing hardware corresponding to a client device;

determining three or more acoustic quality metrics for the speech audio input by analyzing the speech audio input utilizing a plurality of acoustic quality measurement models comprising four or more of a direct-to-reverberant ratio model, a reverberation time model, a voice activity detection model, a signal-to-noise ratio model, a perceived loudness model, a peak loudness model, a glitch detection model, a dropout detection model, a handling noise model, or a pop noise detection model;

determining, based on the three or more acoustic quality metrics, a plurality of acoustic improvement suggestions from a set of acoustic improvement suggestions;

providing, for display via an interactive graphical user interface, a first acoustic improvement suggestion of the plurality of acoustic improvement suggestions concurrently displayed with visualizations of the three or more acoustic quality metrics in response to detecting a first user interaction with a first displayed acoustic quality metric of the three or more acoustic quality metrics, wherein the three or more acoustic quality metrics comprise three or more of a microphone distance metric, a loudness metric, a room characteristics metric, and a noise level metric; and providing, for display via the interactive graphical user interface, a second acoustic improvement suggestion of the plurality of acoustic improvement suggestions concurrently displayed with the visualizations of the three or more acoustic quality metrics in response to detecting a second user interaction with a second displayed acoustic quality metric of the three or more acoustic quality metrics.

18. The computer-implemented method of claim 17, further comprising determining the noise level metric based on combining outputs of multiple acoustic quality measurement models of the plurality of acoustic quality measurement models.

19. The computer-implemented method of claim 17, further comprising providing a third actionable acoustic improvement suggestion of the plurality of acoustic improvement suggestions in response to detecting a third user interaction with a third displayed acoustic quality metric of the three or more acoustic quality metrics.

20. The computer-implemented method of claim 17, wherein the plurality of acoustic improvement suggestions comprises text-based suggestions.

* * * * *